US009615165B2

(12) United States Patent
Herold et al.

(10) Patent No.: US 9,615,165 B2
(45) Date of Patent: Apr. 4, 2017

(54) LOUDSPEAKER DEVICE HAVING FOAM INSERT TO IMPROVE GAS DISTRIBUTION IN SOUND ADSORBER MATERIAL

(71) Applicants: Josef Herold, Wulkaprodersdorf (AT); Christoph Schmauder, Vienna (AT)

(72) Inventors: Josef Herold, Wulkaprodersdorf (AT); Christoph Schmauder, Vienna (AT)

(73) Assignee: Sound Solutions International Co., Ltd., Beijing (CN)

( * ) Notice: Subject to any disclaimer, the term of this patent is extended or adjusted under 35 U.S.C. 154(b) by 47 days.

(21) Appl. No.: 14/821,460

(22) Filed: Aug. 7, 2015

(65) Prior Publication Data

US 2017/0041704 A1 Feb. 9, 2017

(51) Int. Cl.
*H04R 1/20* (2006.01)
*H04R 1/28* (2006.01)

(52) U.S. Cl.
CPC ..... *H04R 1/288* (2013.01)

(58) Field of Classification Search
USPC ..... 381/345
See application file for complete search history.

(56) References Cited

U.S. PATENT DOCUMENTS 4,657,108 A * 4/1987 Ward ..... H04R 1/2803 181/149
8,565,463 B2 * 10/2013 Saiki ..... H04R 1/2811 381/337

FOREIGN PATENT DOCUMENTS

CN 104202703 A 12/2014

OTHER PUBLICATIONS

International Search Report, PCT/CN2016/093424.
Nritten Opinion of International Search Report, PCT/CN2016/093424.

* cited by examiner

*Primary Examiner* — Amir Etesam
(74) *Attorney, Agent, or Firm* — Steven McMahon Zeller; Dykema Gossett PLLC

(57) ABSTRACT

A loudspeaker device having housing and an acoustic transducer is disclosed. The housing has a transducer space for the acoustic transducer, and a back volume space. The back volume filled with a sound adsorber material and a foam material. The sound adsorber material in the back volume space is configured to virtually increase the size of the back volume space, and shift the resonant frequency of the back volume space. The foam material facilitates gas exchange and air flow within the back volume space, and between the sound adsorber and the transducer space. The foam material is configured in different arrangements to facilitate the gas exchange and air flow.

16 Claims, 14 Drawing Sheets

LOUDSPEAKER DEVICE HAVING FOAM INSERT TO IMPROVE GAS DISTRIBUTION IN SOUND ADSORBER MATERIAL

FIELD OF THE INVENTION

The invention relates to the field of loudspeaker devices and, in particular, to miniature loudspeaker devices having acoustically active materials integrated within the back volume portion of the housing of the loudspeaker device.

BACKGROUND OF THE INVENTION

In the acoustic arts, it is conventional to place a sound adsorber material in a back volume of a loudspeaker device to acoustically enlarge the back volume in a virtual sense. In a loudspeaker device having a physically small back volume, a sound adsorber material lowers the resonance frequency of the loudspeaker device to a value that is similar to a loudspeaker device with a physically larger back volume.

More specifically, sound adsorber materials disposed in the back volume of a loudspeaker device improve its sound characteristics, e.g., the wideband performance, and the apparent acoustic volume of the loudspeaker. Examples of sound adsorber materials include zeolite materials, zeolite-based materials, silica ($SiO_2$), alumina ($Al_2O_3$), zirconia ($ZrO_3$), magnesia (MgO), tri-iron tetroxide ($Fe_3O_4$), molecular sieves, fullerene, carbon nanotubes, and activated carbon or charcoal. Zeolite materials and zeolite-based materials are electrically isolating, unlike activated carbon. Since zeolite materials and zeolite-based materials are electrically non-conductive, they do not affect the electrical components (e.g., the antenna, the battery, the internal electronics, etc.) of a device that incorporates a loudspeaker device having such a sound adsorber material. In addition, the non-conductive zeolite material or zeolite-based material will not cause short circuits if it becomes loose within the device. Furthermore, the packaging of zeolite materials and zeolite-based materials is much easier than in case of activated carbon woven fabrics.

A problem may arise in the insertion or placement of sound adsorber materials consisting of or at least comprising powder, loose particles, or loose grains in the back volume of the loudspeaker device. Furthermore, the back volume of a miniature loudspeaker, such as a loudspeaker device placed in mobile phones, headsets, etc., is often constrained by other circuit components in the immediate physical area surrounding the loudspeaker, and sometimes the shape of the back volume is complex and not acoustically desirable. A conventional technique uses tubes that encase a sound adsorber material, but these usually do not fit well into a back volume having a complex shape. A direct insertion of the sound adsorber materials into the back volume can be practically difficult. Furthermore, if not securely packaged, the sound adsorber materials can enter the different components of the loudspeaker device, as well as the handheld device that uses the loudspeaker device, and can therefore damage the loudspeaker device, or the handheld device that includes the loudspeaker device as a component U.S. application Ser. No. 13/818,374, which is incorporated by reference in its entirety into this disclosure, discloses an audio system that comprises an electro-acoustic transducer or loudspeaker with a housing that forms a resonance volume to improve the quality of the emitted sound. The audio system disclosed in application Ser. No. 13/818,374 comprises a zeolite particulate material or a substantially ball-shaped zeolite granulate material that fills a portion of the resonance volume of a loudspeaker. Zeolite material is a sound adsorbing material that, depending on its formulation, results in a virtual acoustic enlargement of the volume of the resonance space by a factor of 1.5 or greater. As a result, the volume of the housing of the speaker that contains the zeolite material can be made smaller compared to a housing of a speaker filled with air.

The packaging of a zeolite-based material for use as a sound adsorber inside the back volume of a miniature loudspeaker, such as the type usually found in today's handheld consumer electronic devices, has been challenging. The zeolite materials disclosed in the application Ser. No. 13/818,374, although not electrically damaging, can interfere with the proper operation of a miniature loudspeaker, and potentially other components within a handheld consumer electronics device, if not properly contained within the device. In addition, due to the typically limited space within the back volume portion of a miniature loudspeaker, efficient gas exchange can be impeded and the efficiency of the zeolite-based sound adsorber can be lessened by design restrictions. Although the back volume of the miniature loudspeaker might be completely filled with a zeolite-based sound adsorber, if only a limited amount of sound adsorber surface area is exposed to pressure changes caused by acoustic transducer movement, the resonance frequency shift disclosed in application Ser. No. 13/818,374 is limited.

SUMMARY OF THE DISCLOSED INVENTION

The disclosed invention is directed to an acoustic transducer device that contains a sound adsorber material and a foam insert to enhance the efficiency of the sound adsorber material. An embodiment of the acoustic transducer device comprises an acoustic transducer, a transducer housing that has a transducer volume and a back volume, and the transducer volume and the back volume are acoustically coupled. The acoustic transducer is mounted in the transducer volume, and transducer housing has a charging port disposed in the portion of the transducer housing where the back volume is located. A preconfigured foam insert is disposed in the back volume, a permeable member is disposed between the transducer volume and the back volume, and the preconfigured foam insert and the permeable member cooperatively configure a cavity within the back volume. A predetermined amount of sound adsorber material disposed within the cavity defined by the permeable member and preconfigured foam insert, and the preconfigured foam insert and the permeable member facilitate gas exchange between the transducer volume and the back volume. In another embodiment, the preconfigured foam insert is disposed along an interior surface of the back volume. In another embodiment, the preconfigured foam insert is disposed such that the back volume is divided into two cavities, and the transducer housing has comprises a charging port for each of the cavities. In another embodiment of the acoustic transducer, the preconfigured foam insert comprises two foam inserts, each disposed along an interior surface of the back volume. In other embodiments of the acoustic transducer, the preconfigured foam insert has a triangular shape, a complex polygon shape, or a shape having at least one curved surface. In embodiments of the acoustic transducer, the permeable member is one of a group consisting of a polypropylene film comprising gas vents, a fleece material, a mesh material, or a filter material. The acoustic transducer preferably has a sound adsorber material that is a substantially spherically shaped zeolite-based material having a mean diameter of at least 300 microns.

Another embodiment of the acoustic transducer device is a loudspeaker device that comprises a loudspeaker housing having a loudspeaker volume and a preconfigured back volume, with the loudspeaker volume and the back volume acoustically coupled, and with a loudspeaker mounted in the loudspeaker volume. The loudspeaker device comprises a charging port disposed in the portion of the loudspeaker housing where the preconfigured back volume is located, and a preconfigured foam insert disposed in the preconfigured back volume, wherein the preconfigured foam insert is shaped to match the internal surfaces of the preconfigured back volume. The loudspeaker device also has a permeable member disposed between the loudspeaker volume and a preconfigured back volume, and the preconfigured foam insert and the permeable member cooperatively configure a cavity within the preconfigured back volume. The loudspeaker device has a predetermined amount of a sound adsorber material disposed within the cavity defined by the permeable member and the preconfigured foam insert, and the preconfigured foam insert and the permeable member facilitate gas exchange between the transducer volume and the back volume. In embodiments of the loudspeaker device, the preconfigured foam insert has a triangular shape, a complex polygon shape, or a shape having at least one curved surface. In other embodiments, the permeable member is one of a group consisting of a polypropylene film comprising gas vents, a fleece material, a mesh material, or a filter material. Embodiments of the loudspeaker device use a sound adsorber material that has a substantially spherically shaped zeolite-based material with a mean diameter of at least 300 microns.

Another embodiment of the acoustic transducer device is a loudspeaker device that comprises a loudspeaker housing having a loudspeaker volume and a preconfigured back volume, with the loudspeaker volume and the back volume acoustically coupled, and with a loudspeaker mounted in the loudspeaker volume. The loudspeaker device comprises a charging port disposed in the portion of the loudspeaker housing where the preconfigured back volume is located, a preconfigured foam insert disposed in the preconfigured back volume, and the preconfigured foam insert configures a cavity within the preconfigured back volume. The loudspeaker device has a predetermined amount of a sound adsorber material disposed within the cavity defined by the preconfigured foam insert, and the preconfigured foam insert facilitates gas exchange between the transducer volume and the back volume. In embodiments of the loudspeaker device, the preconfigured foam insert has a triangular shape, a complex polygon shape, or a shape having at least one curved surface.

Another embodiment of the acoustic transducer device is a method for manufacturing a loudspeaker device that has a foam channel insert and sound adsorber material. Preferably, the manufacturing method is implemented with computer-controlled manufacturing equipment for the greatest efficiency, although manual assembly of the loudspeaker device is contemplated as well. More specifically, the description of the manufacturing process assumes that the loudspeaker device undergoing assembly has been placed in a carrier device that moves the loudspeaker device through various computer-controlled assembly stations along an assembly track. There might be other steps, such as inserting gaskets or making electrical connections, that are not described in the manufacturing method. These types of steps are generic to the manufacturing process and are not part of the invention. In the manufacturing method embodiment, a preconfigured foam channel insert is inserted into position in the back volume of the housing of the loudspeaker device. If the foam channel insert embodiment requires a permeable member, the permeable member will have already been inserted into the housing of the loudspeaker device. Next, a lid is attached the rest of the housing of the loudspeaker device, thereby sealing the foam channel insert and, if required, the permeable member into the back volume of the housing of the loudspeaker device. A dosing funnel is aligned with the charging port in the housing of the loudspeaker device. The alignment with the charging port is done by computer or manually. A predetermined amount of the sound adsorber material is loaded into the dosing hopper, and the amount of sound adsorber material that will be loaded into the back volume of the loudspeaker housing is determined based upon the desired acoustic effects that the designer wishes to achieve. The measurement of the amount of sound adsorber material for insertion into the back volume of the loudspeaker housing is performed either volumetrically or gravimetrically. The loudspeaker device undergoing dosing is vibrated while the sound adsorber material is being poured from the dosing hopper into the dosing funnel, and thence into the back volume of the loudspeaker device. Next, the vibration of the carrier holding the loudspeaker device is halted for a predetermined amount of time, then the vibration of the loudspeaker device is resumed for a predetermined amount of time. After vibration, the level of the sound adsorber material inside the back volume of the loudspeaker device is measured, either visually or by computer-controlled instrument.

The measured level of the sound adsorber material in the back volume is compared against the design requirements for the particular loudspeaker device being manufactured. If the level of sound adsorber material is below design specifications, the loudspeaker device rejected. If the level of sound adsorber material is within design specifications, then the dosing funnel is removed from the granulate charging port in the housing of the loudspeaker device under manufacture. Next, the charging port in the housing of the loudspeaker device under manufacture is sealed to prevent the escape of sound adsorber material from the back volume, and the charging port can be sealed with an insert that fits into the charging port, an adhesive strip placed over the charging port, or a cover over the charging port attached with suitable adhesive. After the charging port has been sealed, the loudspeaker device is now complete and ready for audio testing.

Other features and advantages of the disclosed invention will be apparent from the following specification taken in conjunction with the following drawings.

BRIEF DESCRIPTION OF THE DRAWINGS

The accompanying drawings, which are incorporated in and constitute a part of this specification, illustrate embodiments of the invention and, together with the description, serve to explain the objects, advantages, and principles of the invention. In the drawings.

Skilled artisans will appreciate that elements in the Figures are illustrated for simplicity and clarity. It will further be appreciated that certain actions and/or steps may be described or depicted in a particular order of occurrence while those skilled in the art will understand that such specificity with respect to sequence is not actually required. It will also be understood that the terms and expressions used herein have the ordinary meaning as is accorded to such terms and expressions with respect to their corresponding respective areas of inquiry and study except where specific meanings have otherwise been set forth herein.

DETAILED DESCRIPTION OF THE DISCLOSED EMBODIMENTS

A detailed description of disclosed embodiments will be provided with reference to the accompanying drawings.

Although the invention is susceptible to embodiments in many different forms, the drawings show, and as will be described in detail, preferred embodiments of the invention with the understanding that the present disclosure is to be considered as an exemplification of the principles of the invention and is not intended to limit the broad aspect of the invention to the embodiments illustrated.

Figure 1:
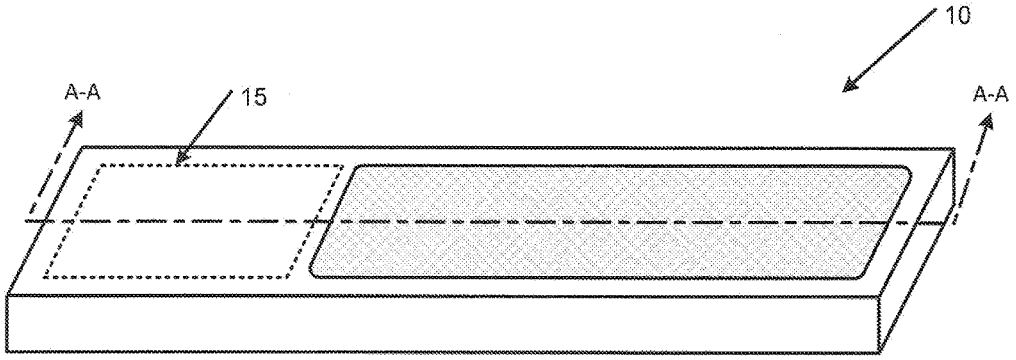
FIG. 1 is a three-quarters view of a loudspeaker device for mounting within an acoustic device.

Referring to FIG. 1, a loudspeaker device 10 is illustrated. The loudspeaker device 10 comprises an upper loudspeaker housing 13, a lower loudspeaker housing 14, and an acoustic transducer 12. The upper loudspeaker housing 13 is joined to the lower loudspeaker housing 14 with fasteners, locking tabs, or a suitable adhesive. Preferably, the adhesive used to join the upper and lower loudspeaker housings 13, 14 does not have any outgassing characteristics that could affect the sound adsorber material in the back volume, and impact its effectiveness. The location of the sound adsorber 15 in the loudspeaker device 10 is shown with dotted lines, as the sound adsorber 15 is internally disposed within the loudspeaker device 10. The upper loudspeaker housing 13 comprises a transducer opening that allows sound propagation/air flow from the acoustic transducer 12 into the space outside the device. Other elements of the loudspeaker device, such as electrical contacts, gaskets, and internal wiring, are not shown in FIG. 1.

Figure 2:
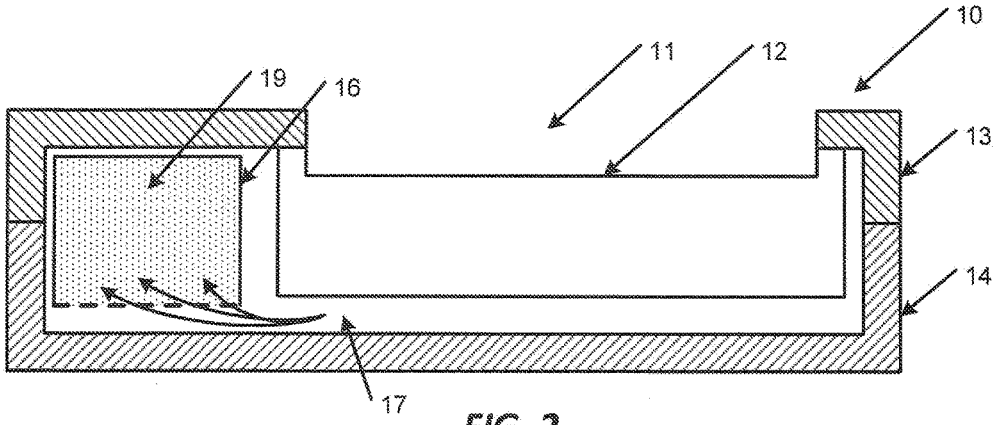
FIG. 2 is a longitudinal cross-sectional view of the loudspeaker device of FIG. 1 with a first embodiment for containing sound adsorber material.

Referring to FIG. 2, one method of packaging the sound adsorber material 19 is illustrated. As used herein, "sound adsorber material" refers to the zeolite materials disclosed in application Ser. No. 13/818,374, but other sound adsorber materials could be used if necessary. As shown in FIG. 2 along section line A-A, the back volume 17 of the loudspeaker device 10 extends around the acoustic transducer 12 and into the internal portion of the back volume where the sound adsorber pouch 16 is disposed. A technique of using a pouch to enclose the sound adsorber material 19 is disclosed in U.S. application Ser. No. 14/003,217, which is incorporated by reference in its entirety into this disclosure.

As disclosed in application Ser. No. 14/003,217, the sound adsorber pouch 16 is manufactured to fit within the internal contours of the back volume, and one side of the sound adsorber pouch 16 comprises a gas permeable material having a low acoustic resistance that facilitates gas exchange between the back volume and the interior volume of the sound adsorber pouch 16. The gas permeable material must also retain the sound adsorber material 19 within the interior chamber of the pouch. The remaining sides of the sound adsorber pouch 16 are manufactured from a material that is relatively impermeable to gas, or has a high acoustic resistance. The sound adsorber pouch 16 is positioned such that gas exchange occurs between the sound adsorber material 19 and the back volume 17 through the permeable material.

Figure 3:
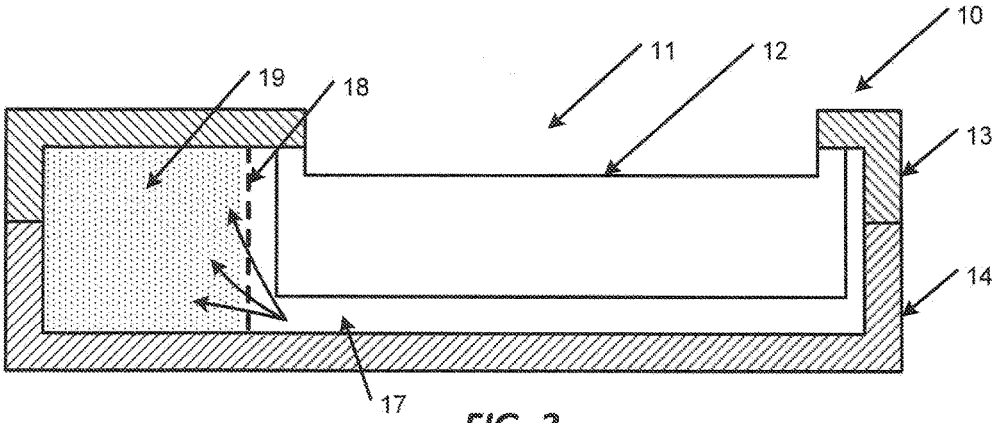
FIG. 3 is a longitudinal cross-sectional view of the loudspeaker device of FIG. 1 with a second embodiment for containing sound adsorber material.

Referring to FIG. 3, another method of retaining the sound adsorber material 19 within the back volume of the loudspeaker device 10 is illustrated. As shown in FIG. 3 along section line A-A, instead of a sound adsorber pouch 16, a permeable wall 18 is disposed within the back volume 17. The permeable wall 18 is retained in its position within the back volume 17 by tabs, flanges, or suitable adhesive. If an adhesive is used, it preferably does not have any outgassing characteristics that could affect the sound adsorber material in the back volume, and affect its sorption capabilities. The permeable wall 18 may comprise a punched or etched polypropylene material, a mesh material with low acoustic resistance, a filter material, or other gas permeable materials that have a low acoustic resistance. As shown in FIG. 3, the sound adsorber material 19 is retained in a portion of the back volume 17 that is opposite to the location of the acoustic transducer 12.

As shown in FIGS. 2 and 3, gas exchange between the sound adsorber material 19 and the back volume 17 is facilitated through a gas permeable material placed between the sound adsorber material 19 and the back volume 17. However, as shown in FIGS. 2 and 3, the sound adsorber material 19 that is at the interface with the back volume, i.e., immediately adjacent to the gas permeable material, will adsorb or desorb gas before the sound adsorber material 19 that is well away from the back volume interface. Even if the sound adsorber material 19 is a granulate (as opposed to much smaller particles), the sound adsorber material 19 presents acoustic resistance to the gas passing through the gas permeable material. This acoustic resistance causes the sound adsorber material 19 closest to the back volume interface to interact more with the gas exchange, whereas the sound adsorber further away from the gas permeable material has less interaction. This uneven interaction in the gas exchange can cause a reduction in efficiency of the sound adsorber material 19 (if the path through sound adsorber material is too long/too narrow).

Figure 4A:
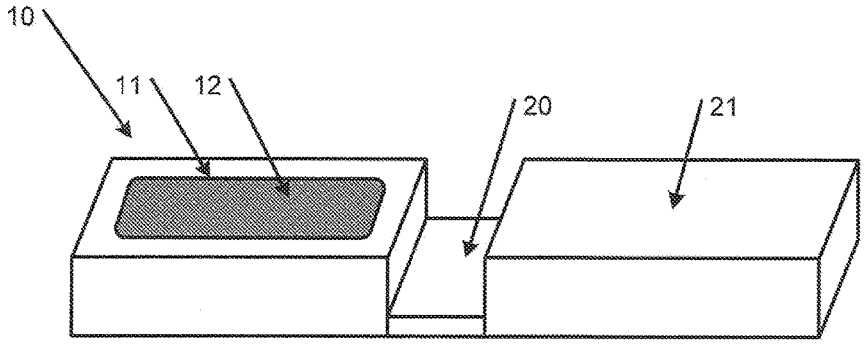
FIG. 4A is a three-quarters view of a loudspeaker device having a large back volume coupled to the transducer space via a restriction.
Figure 4B:
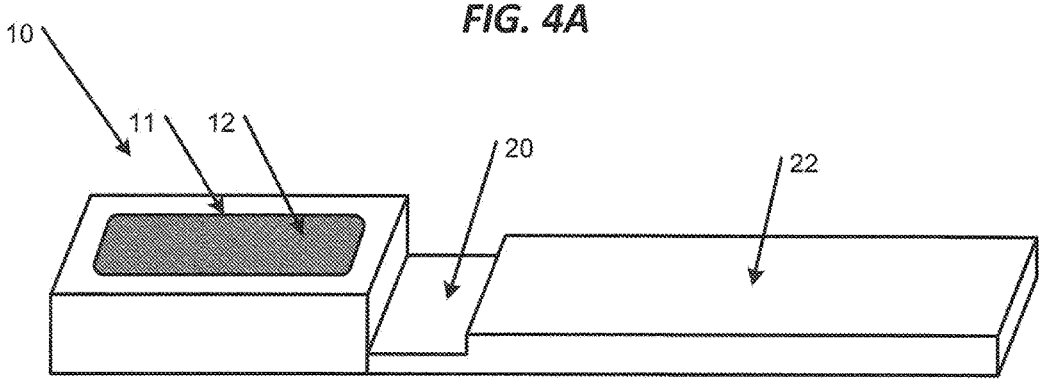
FIG. 4B is a three-quarters view of a loudspeaker device having a small back volume coupled to the transducer space via a restriction.
Figure 4C:
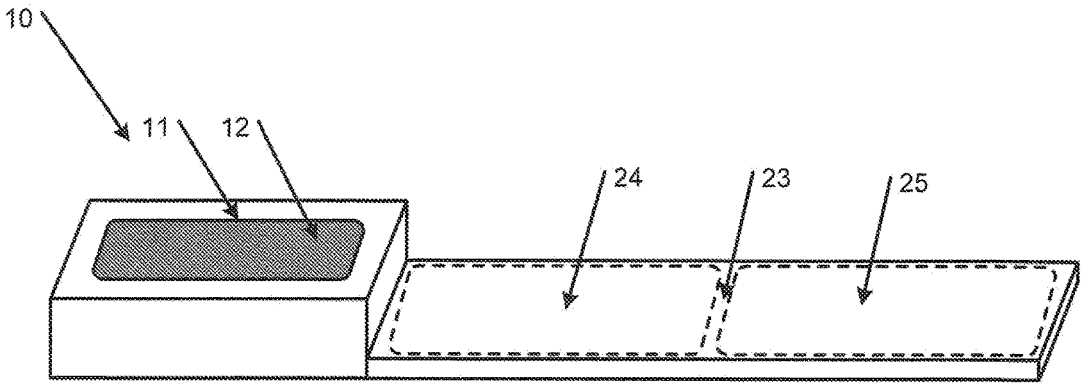
FIG. 4C is a three-quarters view of a loudspeaker device having a slit back volume.

As noted above, the shape of the housing of the loudspeaker device 10 can influence the amount of exposed surface area the sound adsorber material 19 can present to the gases in the back volume 17. Referring to FIGS. 4A-4C, three different types of loudspeaker device configurations are shown that have sound adsorber material disposed within their respective back volumes, but the shape of the loudspeaker housing limits the amount of surface area of the sound adsorber material that can be exposed to the acoustic energy generated by the acoustic transducer.

In FIG. 4A, the loudspeaker device 10 has a housing that contains an acoustic transducer 11. The housing of the loudspeaker device 10 further comprises a back volume 21 that is acoustically coupled to the acoustic transducer 11 via a restriction section 20. The restriction section 20 facilitates the passage of gas between the portion of the housing containing the acoustic transducer 12 and the portion of the housing containing the back volume 21. As shown in FIG. 4A, the restriction section 20 has a cross-sectional are that is much smaller than the cross-section of the back volume 21. This small cross-sectional area of the restriction section 20 limits the gas exchange between the portion of the housing containing the acoustic transducer 12 and the portion of the housing containing the back volume 21. The result is the sound adsorber material 19 disposed in the back volume 21 is less effective due to the effect of the restriction section 20 on gas exchange.

In FIG. 4B, the loudspeaker device 10 illustrated therein has a structure similar to the loudspeaker device shown in FIG. 4A, but with a smaller slit back volume 22. The loudspeaker device 10 has a restriction section 20 that affects the gas exchange between the portion of the housing containing the acoustic transducer 12 and the portion of the housing containing the slit back volume 22. The result is the sound adsorber material 19 disposed in the back volume 22 is less effective due to the effect of the restriction section 20 on gas exchange.

In FIG. 4C, there is no restriction section as the slit back volume 23 has the same cross-sectional area of the restriction section 20 shown in FIGS. 4A and 4B. This cross-sectional area is relatively uniform along the length of the slit back volume 23. The sound adsorber material 19 disposed in the second portion 25 of the slit back volume 23 has little effect on the acoustic energy from the acoustic transducer due to the collective acoustic resistance of the sound adsorber material 19 disposed in the first portion 24 of the slit back volume 23. If the sound adsorber material 19 is constituted in powder or particle form, as opposed to granulate form, the acoustic resistance in the first portion 24 of the slit back volume 23 might be even larger.

To improve the effectiveness of the sound adsorber material 19 when disposed in back volume cavities that expose very limited amounts of surface area of the sound adsorber, gas must have a channel (or channels) into the sound adsorber material 19 that has a low acoustic resistance and reaches deep into the volume occupied by the sound adsorber. There have been prior art devices described to improve air flow into the sound adsorber but these devices appear complicated to manufacture. See U.S. Pat. No. 7,974,423 and U.S. Patent Application Publication No. 2008/0170737 A1. If the sound adsorber material is constituted in powder, particulate, or granulate form, molding is not a viable solution. The housing of the loudspeaker device 10 could have air channels molded into volume that is occupied by the sound adsorber material 19, but that increases the complexity of the housing and consequently the manufacturing costs.

FIGS. 5-11 disclose various embodiments of the invention that provides a low acoustic resistance air channel to the sound adsorber material while retaining the sound adsorber material within the back volume are shown. The disclosed embodiments of the invention increase the amount of exposed surface area of the sound adsorber material without having to increase the size of the housing of the loudspeaker device. Although the loudspeaker device 10 shown in FIGS. 5-11 is the loudspeaker device embodiment depicted in FIG. 4C, the concepts of the invention can be applied to any housing for a loudspeaker device having a constricted back volume that uses a sound adsorber material to change the acoustic compliance of the gas in the back volume of the loudspeaker device. In addition, the concepts of the invention can be applied to other acoustic devices, such as microphones, that have back volumes that use a sound adsorber material to change the acoustic compliance of the gas in the back volume of the acoustic device.

Preferably, the sound adsorber material 19 is a loose zeolite granulate material as disclosed in U.S. application Ser. No. 14/818,374, which is incorporated by reference in its entirety. More preferably, the loose zeolite granulate material, for use as the sound adsorber material 19, is substantially spherical and has a diameter range of 100 microns or greater. The loose zeolite granulate material is preferable for its ease of use in manufacturing an acoustic device of the type disclosed herein. Other types of sound adsorber material, such as zeolite powder or activated charcoal, can be used as well, but might not be as easy to use in the manufacturing processes.

Figure 5A:
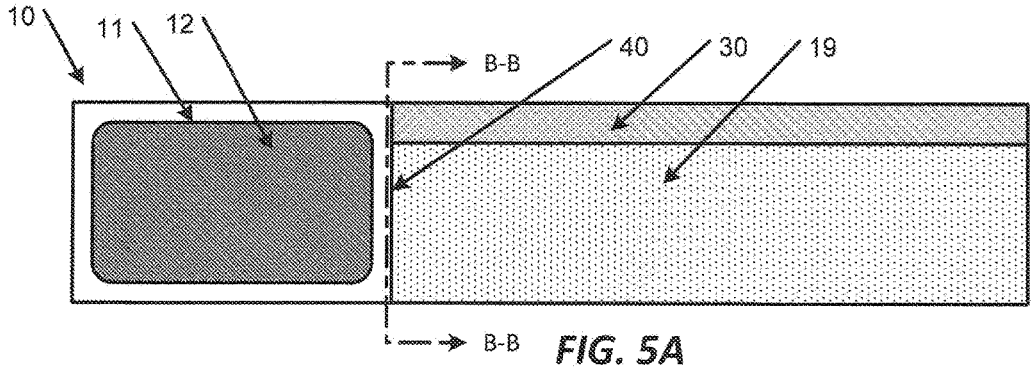
FIG. 5A is an internal view of a loudspeaker device having a slit back volume with a foam channel insert and sound adsorber material.

Referring to FIG. 5A, an embodiment of the invention is illustrated. The loudspeaker device 10 of FIG. 4C is shown in a top-down view, with the slit back volume 23 exposed. In the slit back volume 23, an amount of the sound adsorber material 19 is disposed. The amount of sound adsorber material 19 disposed in the slit back volume 23 is determined based on a number of factors, including the desired resonant frequency shift. A foam channel insert 30 is disposed adjacent to the sound adsorber material 19. Suitable material for the foam channel insert 30 can be BAESOTECT® or other similar materials having an acoustic resistance of 260 MKS rayls or less. In the embodiment disclosed in FIG. 5A, the foam channel insert 30 is substantially equal in length to the length of the slit back volume 23. At the section line B-B, a permeable member 40 (not shown) retains the sound adsorber material 19 and prevents it from spilling or otherwise becoming loose within the remainder of the back volume surrounding the acoustic transducer 12. The foam channel insert 30 increases distribution of the air flow into the slit back volume 23, thereby allowing more of the sound adsorber material 19 to be exposed to the air flow.

Figure 5B:
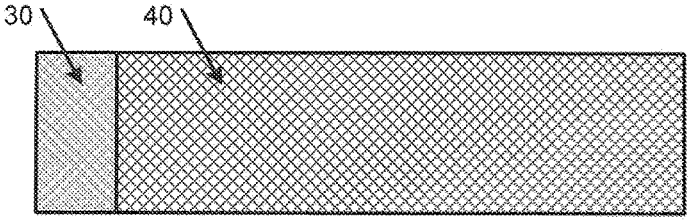
FIG. 5B is a cross-sectional view along section line B-B of the permeable member and an end of the foam channel insert.

Referring to FIG. 5B, the cross-section of the slit back volume 23 at the section line B-B is illustrated. The cross-section of the foam channel insert 30 is shown on the left side of FIG. 5B, and the permeable member 40 is shown on the right side of FIG. B. The permeable member 40 may comprise a punched or etched polypropylene material, a mesh material with low acoustic resistance, a filter material, or other gas permeable materials that have a low acoustic resistance. For example, a mesh material suitable for use as the permeable member 40 might have a nominal thickness of 115 micrometers, a pore size of 130 micrometers, and an acoustic resistance of 8.5 MKS rayls. For an embodiment of the permeable member 40, the material covering the a portion of the opening to the slit back volume 23 must have an acoustic resistance below a certain threshold, typically 260 MKS rayls. If the opening to the slit back volume 23 is small, the selection of material to be used as the permeable member 40 might cause the acoustic resistance at the opening to exceed the 260 MKS rayls threshold limit, thereby leading to acoustical poor performance. In certain embodiments, if the 260 MKS rayls threshold limit is exceeded, the gases entering the slit back volume 23 might be impeded from reaching all of the sound adsorber material 19. For example, if a fleece material is selected for use as the permeable member 40, care must be taken that the 260 MKS rayls threshold limit is not exceeded, especially if the opening to the slit back volume 23 is small.

Figure 6A:
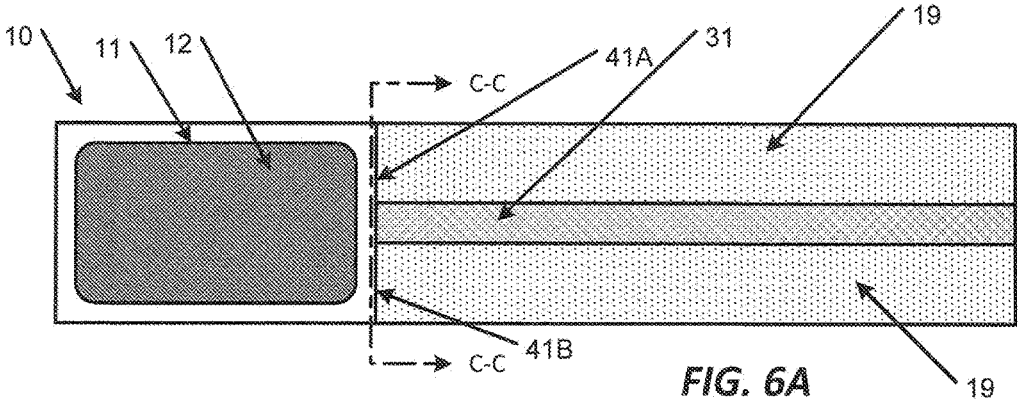
FIG. 6A is an internal view of a loudspeaker device having a slit back volume with a foam channel insert and sound adsorber material.

Referring to FIG. 6A, another embodiment of the invention is illustrated. The loudspeaker device 10 of FIG. 4C is shown in a top-down view, with the slit back volume 23 exposed. In the slit back volume 23, an amount of the sound adsorber material 19 is disposed. The amount of sound adsorber material 19 disposed in the slit back volume 23 is determined based on a number of factors, including the desired resonant frequency shift. A foam channel insert 31 bisects the sound adsorber material 19. Suitable material for the foam channel insert 31 is identical or substantially similar to the foam channel insert 30 shown in FIG. A. In the embodiment disclosed in FIG. 6A, the foam channel insert 31 is substantially equal in length to the length of the slit back volume 23. At the section line C-C, a permeable member 41A, 41B (not shown) retains the sound adsorber material 19 and prevents it from spilling or otherwise becoming loose within the remainder of the back volume surrounding the acoustic transducer 12. The foam channel insert 31 increases distribution of the air flow into the slit back volume 23, thereby allowing more of the sound adsorber material 19 to be exposed to the air flow. The foam channel insert 31 distributes the air flow into the sound adsorber material 19 along two sides of the foam channel insert 31 that are exposed to the sound adsorber material.

Figure 6B:
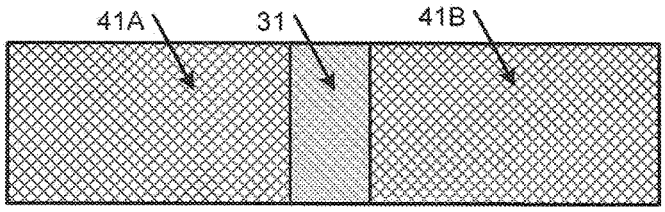
FIG. 6B is a cross-sectional view along section line C-C of the dual permeable members and an end of the foam channel insert.

Referring to FIG. 6B, the cross-section of the slit back volume 23 at the section line C-C is illustrated. The cross-section of the foam channel insert 31 is shown center of FIG. 6B, and the permeable members 41A, 41B are shown on the left and right sides, respectively, of FIG. 6B. The permeable members 41A, 41B may comprise the same materials that are used for the permeable member 40 shown in FIG. 5B and have the same acoustic characteristics. In this embodiment of the invention, the surface area of the sound adsorber material exposed along the foam channel insert 31 is double the amount of exposed surface area shown in FIG. 5B, since two sides of the foam channel insert 31 are in contact with the sound adsorber material 19.

Figure 7A:
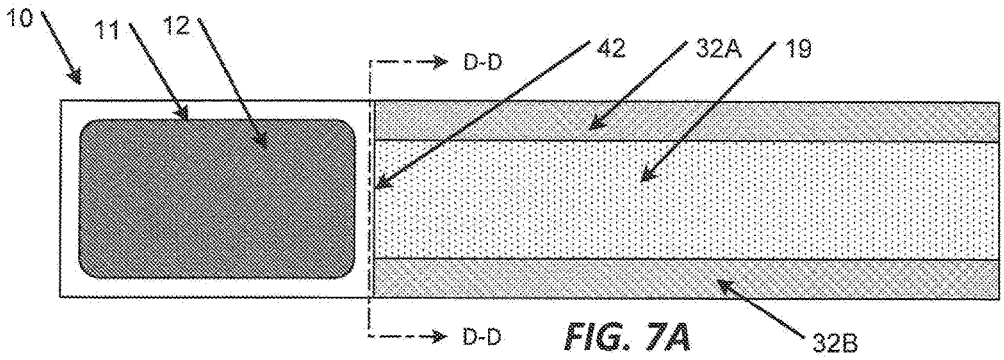
FIG. 7A is an internal view of a loudspeaker device having a slit back volume with dual foam channel inserts and sound adsorber material.

Referring to FIG. 7A, another embodiment of the invention is illustrated. The loudspeaker device 10 of FIG. 4C is shown in a top-down view, with the slit back volume 23 exposed. In the slit back volume 23, an amount of the sound adsorber material 19 is disposed. The amount of sound adsorber material 19 disposed in the slit back volume 23 is determined based on a number of factors, including the desired resonant frequency shift. Two foam channel inserts 32A, 32B are disposed on each side of the sound adsorber material 19. Suitable material for the foam channel inserts 32A, 32B is identical or substantially similar to the foam channel insert 30 shown in FIG. A. In the embodiment disclosed in FIG. 7A, the foam channel inserts 32A, 32B are substantially equal in length to the length of the slit back volume 23. At the section line D-D, a permeable member 42 (not shown) retains the sound adsorber material 19 and prevents it from spilling or otherwise becoming loose within the remainder of the back volume surrounding the acoustic transducer 12. The foam channel inserts 32A, 32B distributes the air flow into the two sides of the sound adsorber material 19 contained within the slit back volume 23.

Figure 7B:
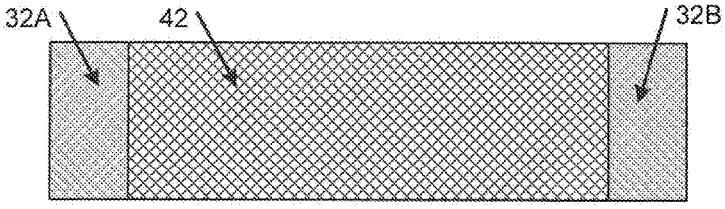
FIG. 7B is a cross-sectional view along section line D-D of the permeable member and the ends of the dual foam channel inserts.

Referring to FIG. 7B, the cross-section of the slit back volume 23 at the section line D-D is illustrated. The cross-section of the foam channel inserts 32A, 32B are shown on the left and right sides, respectively, of FIG. 7B, and the permeable member 42 is shown in the center of FIG. 7B. The permeable member 42 may comprise the same material that are used for the permeable member 40 shown in FIG. 5B and have the same acoustic characteristics. In this embodiment of the invention, the surface area of the sound adsorber material exposed along the foam channel inserts 32A, 32B is double the amount of exposed surface area shown in FIG. 5B, since one side of each foam channel insert 32A, 32B is in contact with the sound adsorber material 19. Since there are now two foam channel inserts, the amount of sound adsorber material 19 might be reduced. This embodiment, however, provides multiple air channels into the sound adsorber material 19. One of ordinary skill in the art would understand that the number of foam channel inserts for providing air channels into the sound adsorber material is not limited to two channels. More than two channels can be used, and the number of foam channel inserts is only limited by the physical characteristics of the housing of the loudspeaker device 10.

Figure 8A:
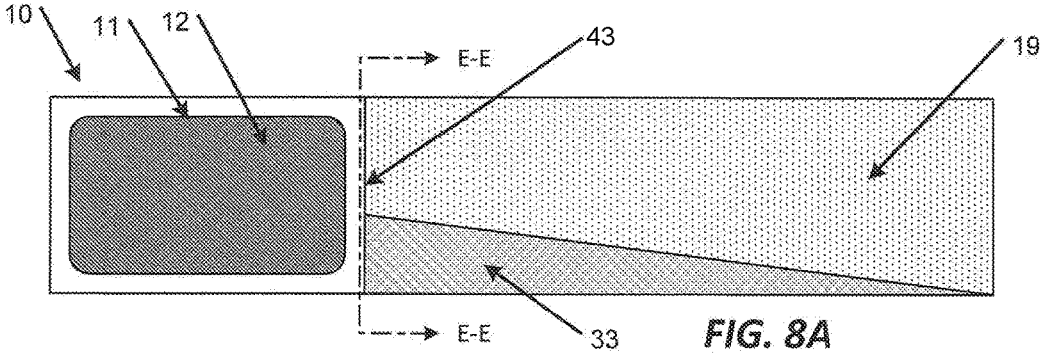
FIG. 8A is an internal view of a loudspeaker device having a slit back volume with a triangular foam channel insert and sound adsorber material.

Referring to FIG. 8A, another embodiment of the invention is illustrated. The loudspeaker device 10 of FIG. 4C is shown in a top-down view, with the slit back volume 23 exposed. In the slit back volume 23, an amount of the sound adsorber material 19 is disposed. The amount of sound adsorber material 19 disposed in the slit back volume 23 is determined based on a number of factors, including the desired resonant frequency shift. A triangular foam channel insert 33 is disposed adjacent to the sound adsorber material 19. Suitable material for the triangular foam channel insert 33 is identical or substantially similar to the foam channel insert 30 shown in FIG. 5A. In the embodiment disclosed in FIG. 8A, the triangular foam channel insert 33 is substantially equal in length to the length of the slit back volume 23. At the section line E-E, a permeable member 43 (not shown) retains the sound adsorber material 19 and prevents it from spilling or otherwise becoming loose within the remainder of the back volume surrounding the acoustic transducer 12. The triangular foam channel insert 33 distributes the air flow into the one side of the sound adsorber material 19 contained within the slit back volume 23, but the shape of the triangular foam channel insert 33 allows more sound adsorber material 19 to be placed in the slit back volume 23.

Figure 8B:
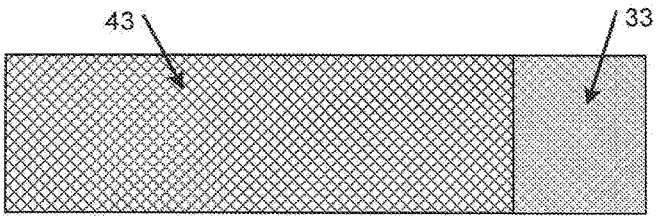
FIG. 8B is a cross-sectional view along section line E-E of the permeable member and an end of the triangular foam channel insert.

Referring to FIG. 8B, the cross-section of the slit back volume 23 at the section line C-C is illustrated. The cross-section of the triangular foam channel insert 33 is shown on the right side of FIG. 8B, and the permeable member 43 is shown on the left side of FIG. 6B. The permeable member 43 may comprise the same materials that are used for the permeable member 40 shown in FIG. 5B and have the same acoustic characteristics. In this embodiment of the invention, the surface area of the sound adsorber material exposed along the triangular foam channel insert 33 is larger than the amount of exposed surface area shown in FIG. 5B, since the hypotenuse of the triangular foam channel insert 33 is longer than the length of the slit back volume 23.

Figure 9A:
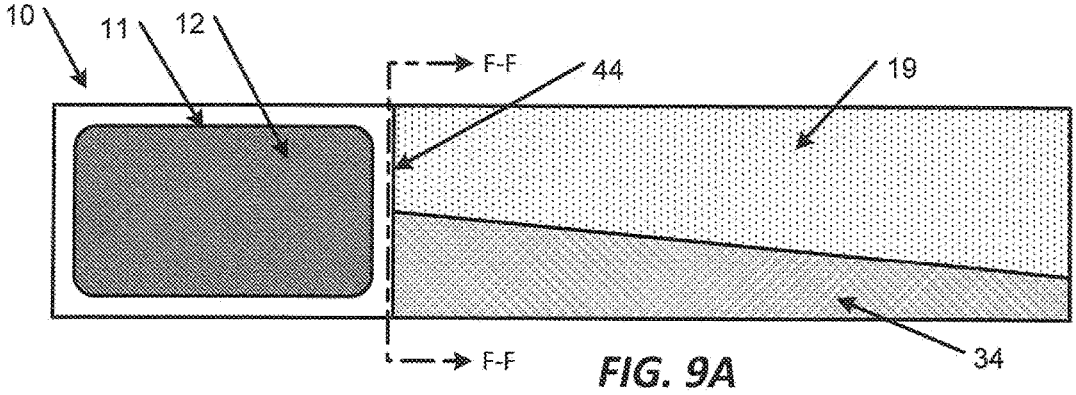
FIG. 9A is an internal view of a loudspeaker device having a slit back volume with a complex polygon foam channel insert and sound adsorber material.

Referring to FIG. 9A, another embodiment of the invention is illustrated. The loudspeaker device 10 of FIG. 4C is shown in a top-down view, with the slit back volume 23 exposed. In the slit back volume 23, an amount of the sound adsorber material 19 is disposed. The amount of sound adsorber material 19 disposed in the slit back volume 23 is determined based on a number of factors, including the desired resonant frequency shift. A convex polygonal foam channel insert 34 is disposed adjacent to the sound adsorber material 19. Suitable material for the convex polygonal foam channel insert 34 is identical or substantially similar to the foam channel insert 30 shown in FIG. 5A. In the embodiment disclosed in FIG. 8A, one side of the convex polygonal foam channel insert 34 is substantially equal in length to the length of the slit back volume 23. At the section line F-F, a permeable member 44 (not shown) retains the sound adsorber material 19 and prevents it from spilling or otherwise becoming loose within the remainder of the back volume surrounding the acoustic transducer 12. The convex polygonal foam channel insert 34 distributes the air flow into the one side of the sound adsorber material 19 contained within the slit back volume 23, but the shape of the convex polygonal foam channel insert 34 allows more sound adsorber material 19 to be placed in the slit back volume 23.

Figure 9B:
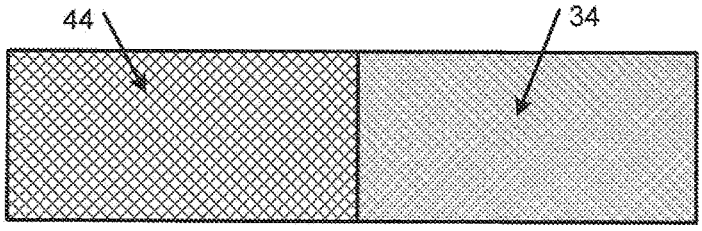
FIG. 9B is a cross-sectional view along section line F-F of the permeable member and an end of the complex polygon foam channel insert.

Referring to FIG. 9B, the cross-section of the slit back volume 23 at the section line F-F is illustrated. The cross-section of the convex polygonal foam channel insert 34 is shown on the right side of FIG. 9B, and the permeable member 44 is shown on the left side of FIG. 9B. The permeable member 44 may comprise the same materials that are used for the permeable member 40 shown in FIG. 5B and have the same acoustic characteristics. In this embodiment of the invention, the surface area of the sound adsorber material exposed along one side of the convex polygonal foam channel insert 34 is larger than the amount of exposed surface area shown in FIG. 5B, since the side of the convex polygonal foam channel insert 34 contacting the sound adsorber material 19 is longer than the length of the slit back volume 23.

Figure 10A:
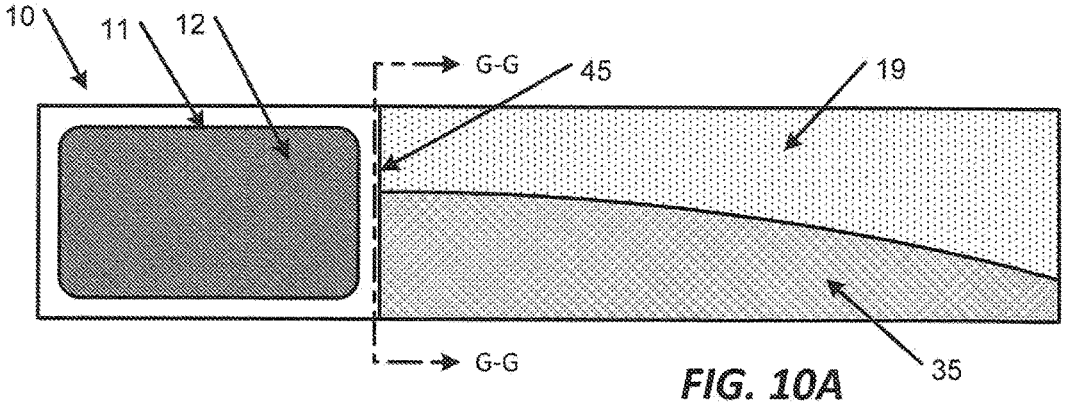
FIG. 10A is an internal view of a loudspeaker device having a slit back volume with a curved foam channel insert and sound adsorber material.

Referring to FIG. 10A, another embodiment of the invention is illustrated. The loudspeaker device 10 of FIG. 4C is shown in a top-down view, with the slit back volume 23 exposed. In the slit back volume 23, an amount of the sound adsorber material 19 is disposed. The amount of sound adsorber material 19 disposed in the slit back volume 23 is determined based on a number of factors, including the desired resonant frequency shift. A curved foam channel insert 35 that has a curved side is disposed adjacent to the sound adsorber material 19. Suitable material for the curved foam channel insert 35 is identical or substantially similar to the foam channel insert 30 shown in FIG. A. In the embodiment disclosed in FIG. 10A, one side of the curved foam channel insert 35 is substantially equal in length to the length of the slit back volume 23. At the section line G-G, a permeable member 45 (not shown) retains the sound adsorber material 19 and prevents it from spilling or otherwise becoming loose within the remainder of the back volume surrounding the acoustic transducer 12. The curved foam channel insert 35 distributes the air flow into the one side of the sound adsorber material 19 contained within the slit back volume 23, but the shape of the curved foam channel insert 35 decreases somewhat the amount of sound adsorber material 19 that can be placed in the slit back volume 23.

Figure 10B:
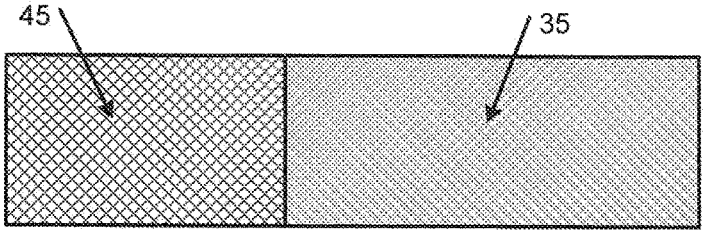
FIG. 10B is a cross-sectional view along section line G-G of the permeable member and an end of the curved foam channel insert.

Referring to FIG. 10B, the cross-section of the slit back volume 23 at the section line G-G is illustrated. The cross-section of the curved foam channel insert 35 is shown on the right side of FIG. 10B, and the permeable member 45 is shown on the left side of FIG. 10B. The permeable member 45 may comprise the same materials that are used for the permeable member 40 shown in FIG. 5B and have the same acoustic characteristics. In this embodiment of the invention, the surface area of the sound adsorber material exposed along one side of the curved foam channel insert 35 is larger than the amount of exposed surface area shown in FIG. 5B, since the side of the curved foam channel insert 35 contacting the sound adsorber material 19 is longer than the length of the slit back volume 23.

Figure 11A:
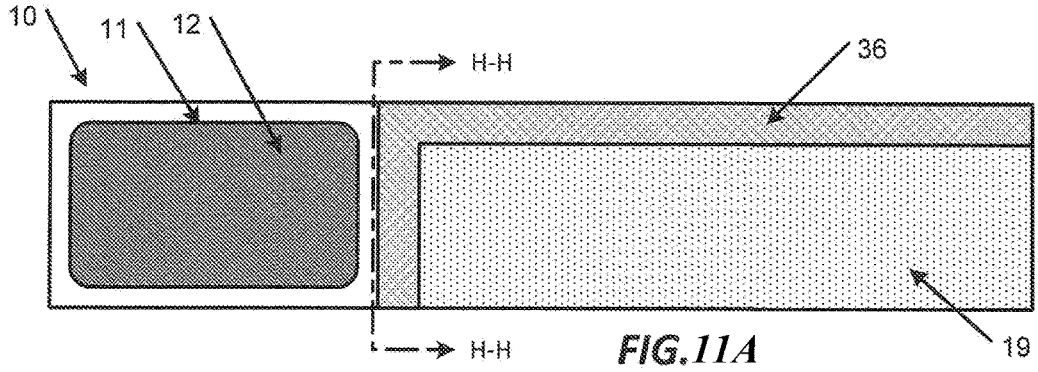
FIG. 11A is an internal view of a loudspeaker device having a slit back volume with a L-shaped foam channel insert and sound adsorber material.

Referring to FIG. 11A, an embodiment of the invention is illustrated. The loudspeaker device 10 of FIG. 4C is shown in a top-down view, with the slit back volume 23 exposed. In the slit back volume 23, an amount of the sound adsorber material 19 is disposed. The amount of sound adsorber material 19 disposed in the slit back volume 23 is determined based on a number of factors, including the desired resonant frequency shift. An L-shaped foam channel insert 36 is configured such that it is between the sound adsorber material 19 and the acoustic transducer 12, as well as adjacent to the sound adsorber material 19. Suitable material for the L-shaped foam channel insert 36 is identical or substantially similar to the foam channel insert 30 shown in FIG. A. In the embodiment disclosed in FIG. 11A, the L-shaped foam channel insert 36 is substantially equal in length to the length of the slit back volume 23, as well as being substantially equal to the width of the slit back volume 23. Instead of a permeable member, the L-shaped foam channel insert 36 retains the sound adsorber material 19 and prevents it from spilling or otherwise becoming loose within the remainder of the back volume surrounding the acoustic transducer 12. The L-shaped foam channel insert 36 distributes the air flow into two sides of the sound adsorber material 19 contained within the slit back volume 23.

Figure 11B:
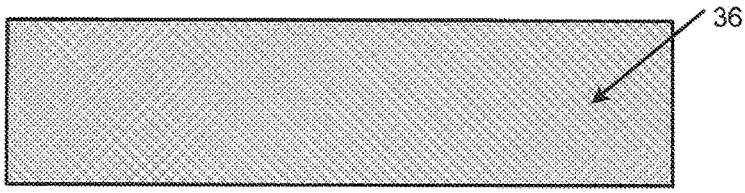
FIG. 11B is a cross-sectional view along section lines H-H of the L-shaped foam channel insert.

Referring to FIG. 11B, the cross-section of the slit back volume 23 at the section line H-H is illustrated. Unlike the other embodiments of the invention, the embodiment shown in FIG. 11A does not require a permeable member to retain the sound adsorber material 19 is its designated location in the slit back volume 23. The L-shaped foam channel insert 36 needs to have sufficient thickness at the portion where it fills the cross-section of the slit back volume 23 (e.g., at section line H-H) to retain the sound adsorber material 19. Furthermore, the acoustic resistance of the L-shaped foam channel insert 36 at the section line H-H should preferably be below a threshold of 260 MKS rayls.

Figure 11C:
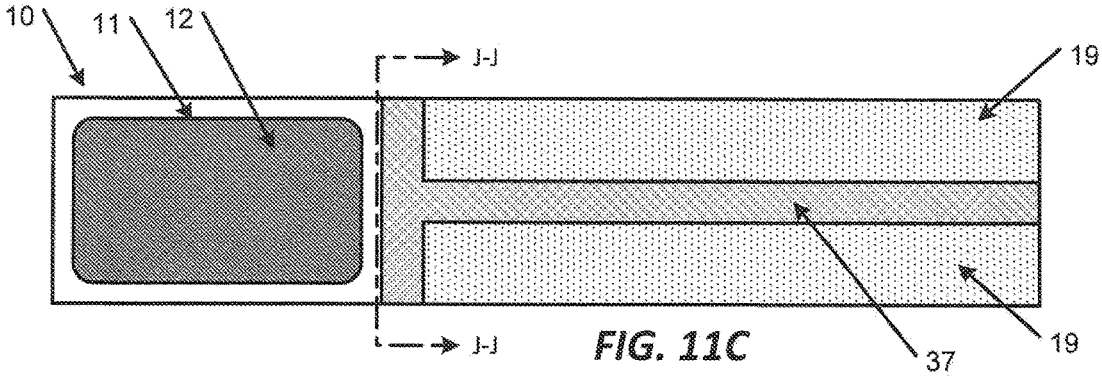
FIG. 11C is an internal view of a loudspeaker device having a slit back volume with a T-shaped foam channel insert and sound adsorber material.

Referring to FIG. 11C, an embodiment of the invention is illustrated. The loudspeaker device 10 of FIG. 4C is shown in a top-down view, with the slit back volume 23 exposed. In the slit back volume 23, an amount of the sound adsorber material 19 is disposed. The amount of sound adsorber material 19 disposed in the slit back volume 23 is determined based on a number of factors, including the desired resonant frequency shift. A T-shaped foam channel insert 37 is configured such that it is between the sound adsorber material 19 and the acoustic transducer 12, as well as having an extension into the slit back volume 23 such that the sound adsorber material 19 is on both sides of the T-shaped foam channel insert 37. The embodiment shown in FIG. 11C does not require a permeable member to retain the sound adsorber material 19 is its designated location in the slit back volume 23, as the cross-section of the T-shaped foam channel insert 37 at the section line J-J is identical to the cross-section illustrated in FIG. 11B. The T-shaped foam channel insert 37 needs to have sufficient thickness at the portion where it fills the cross-section of the slit back volume 23 (e.g., at section line J-J) to retain the sound adsorber material 19. In addition, the acoustic resistance of the T-shaped foam channel insert 37 at the section line J-J should preferably be below a threshold of 260 MKS rayls.

Figure 11D:
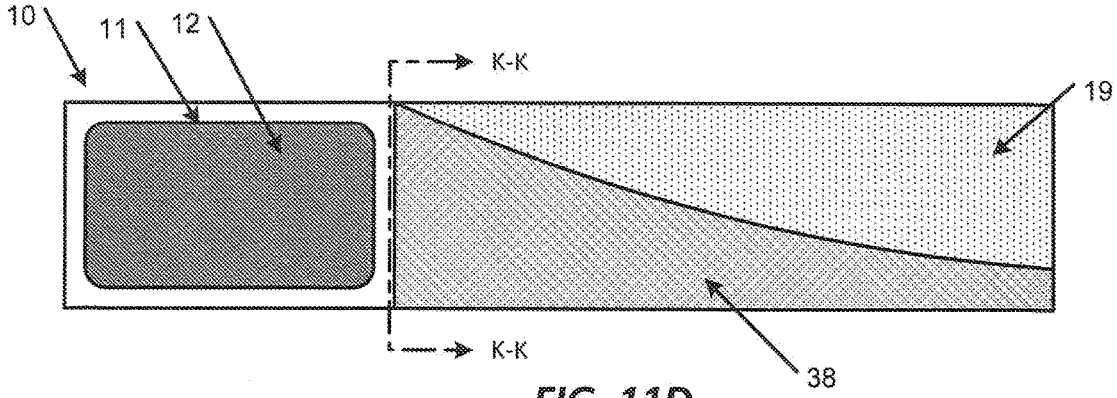
FIG. 11D is an internal view of a loudspeaker device having a slit back volume with a curved foam channel insert and sound adsorber material.

Referring to FIG. 11D, an embodiment of the invention is illustrated. The loudspeaker device 10 of FIG. 4C is shown in a top-down view, with the slit back volume 23 exposed. In the slit back volume 23, an amount of the sound adsorber material 19 is disposed. The amount of sound adsorber material 19 disposed in the slit back volume 23 is determined based on a number of factors, including the desired resonant frequency shift. A curved foam channel insert 38 is configured such that it is between the sound adsorber material 19 and the acoustic transducer 12, as well as having curved shape extending into the slit back volume 23. The embodiment shown in FIG. 11D does not require a permeable member to retain the sound adsorber material 19 is its designated location in the slit back volume 23, as the cross-section of the curved foam channel insert 38 at the section line K-K is identical to the cross-section illustrated in FIG. 11B. The acoustic resistance of the curved foam channel insert 38 at the section line K-K should preferably be below a threshold of 260 MKS rayls.

Figure 12A:
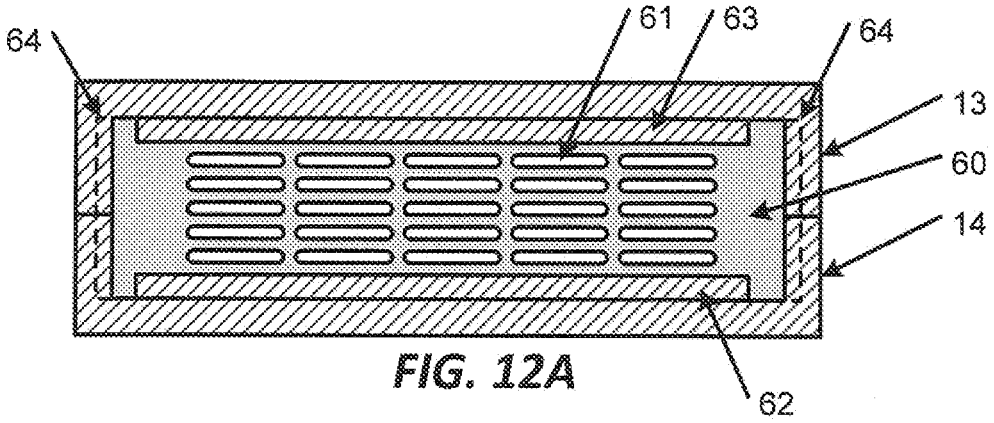
FIG. 12A is an embodiment of a permeable member without a foam channel insert.
Figure 12B:
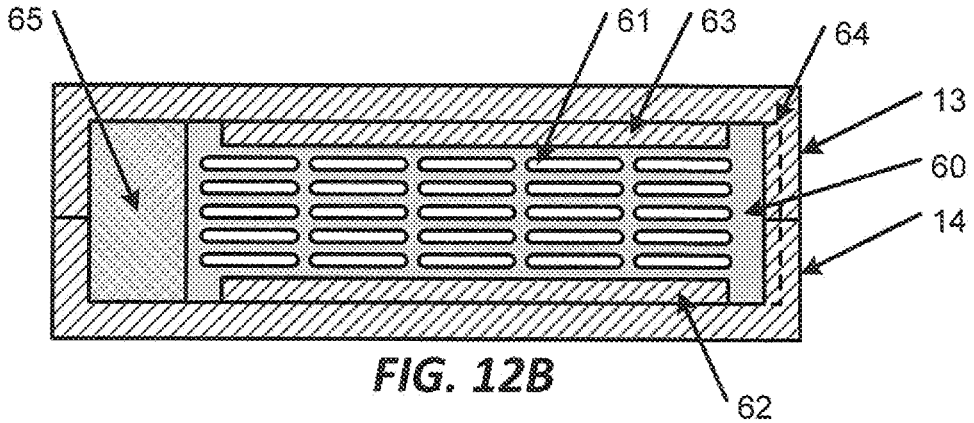
FIG. 12B is a first embodiment of a permeable member with a foam channel insert.
Figure 12C:
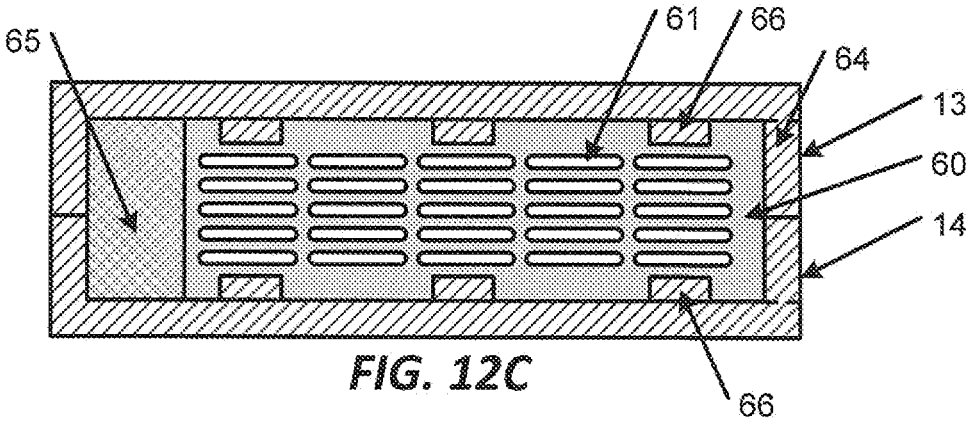
FIG. 12C is a second embodiment of a permeable member with a foam channel insert.

Referring to FIGS. 12A-12C, embodiments of the permeable member used in the embodiments shown in FIGS. 5-10 are illustrated. As noted, the permeable member may comprise a punched or etched polypropylene material, a mesh material with low acoustic resistance, a filter material, or other gas permeable materials that have a low acoustic resistance. For example, a mesh material suitable for use as the permeable member might have a nominal thickness of 115 micrometers, a pore size of 130 micrometers, and an acoustic resistance of 8.5 MKS rayls. For an embodiment of the permeable member, the material covering a portion of the opening to the back volume must have an acoustic resistance below a certain threshold, typically 260 MKS rayls. If the opening to the back volume is small, the selection of material to be used as the permeable member might cause the acoustic resistance at the opening to exceed the 260 MKS rayls threshold limit, thereby leading to acoustical poor performance. In certain embodiments, if the 260 MKS rayls threshold limit is exceeded, the gases entering the back volume might be impeded from reaching all of the sound adsorber material. For example, if a fleece material is selected for use as the permeable member, care must be taken that the 260 MKS rayls threshold limit is not exceeded, especially if the opening to the back volume is small.

In FIG. 12A, a permeable member 60 is shown that covers the entirety of the opening to the back volume is shown for purposes of illustrating the improvement in air flow provided by a foam insert (or inserts) disposed in the back volume. The permeable member 60 covers the entire opening of the back volume, and the permeable member 60 is provided with a plurality of gas ports 61. Although the gas ports 61 depicted in FIG. 12 are oblong in shape, any geometrical shape can be used, provided that the geometrical shape used prevents the escape of sound adsorber material. For example, if the sound adsorber material used is a substantially spherical zeolite material having a mean diameter of 450 microns, then the geometrical shape of the gas ports 61 need to be sufficiently small so as to prevent passage of the spherical zeolite material through the gas ports 61. Retainer flanges 62, 63 hold the permeable member 60 in place and provide structural stiffness and support along the length of the permeable member. At the ends of the permeable member 60, there is a retainer recess 64 molded into the upper and lower loudspeaker housings 13, 14 to assist in retaining the permeable member 60 in place, and providing vertical structural integrity.

Referring to FIG. 12B, an embodiment of the permeable member 60 with a foam channel insert 65 is depicted. The structure of the upper and lower loudspeaker housings 13, 14 shown in FIG. 12B is identical to the structure shown in FIG. 12A, except that the retainer flanges 62, 63 and the permeable member 60 have been shortened to accommodate the foam channel insert 65. In addition, the retainer recess 64 molded on the side of the upper and lower loudspeaker housing 13, 14 where the foam channel insert 65 is located is removed.

Referring to FIG. 12C, another embodiment of the permeable member 60 with a foam channel insert 65 is depicted. The structure of the upper and lower loudspeaker housings 13, 14 shown in FIG. 12C is identical to the structure shown in FIG. 12B, except that the retainer flanges 62, 63 have been replaced with a plurality of retainer tabs 66. The retainer recess 64 molded on the side of the upper and lower loudspeaker housing 13, 14 where the foam channel insert 65 is located is removed.

Figure 13A:
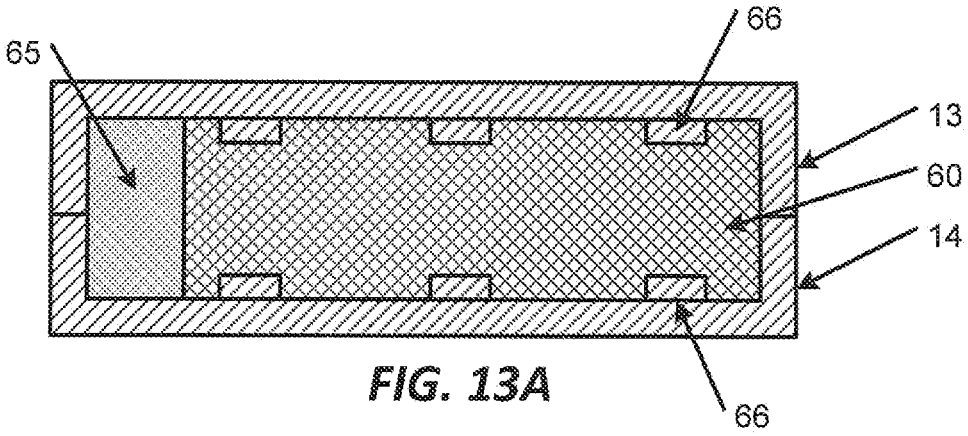
FIG. 13A is a third embodiment of a permeable member with a foam channel insert.

Referring to FIG. 13A, another embodiment of the permeable member 60 with a foam channel insert 65 is depicted. The structure of the upper and lower loudspeaker housings 13, 14 shown in FIG. 13A is identical to the structure shown in FIG. 12C, except that the permeable member 60 is a fleece, mesh, or fabric type material that does not require the formation of gas ports 61 in the material. As noted, the acoustic resistance of the fleece, mesh, or fabric type material preferably should not exceed the 260 MKS rayls threshold limit.

Figure 13B:
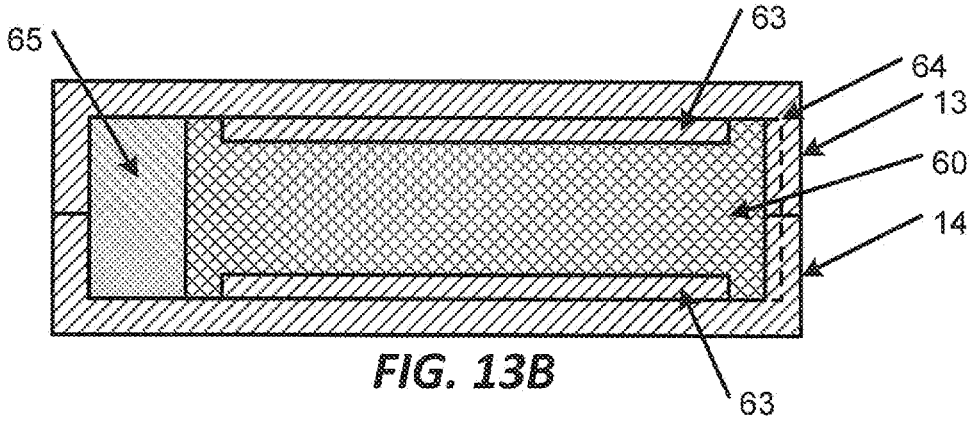
FIG. 13B is a fourth embodiment of a permeable member with a foam channel insert.

Referring to FIG. 13B, another embodiment of the permeable member 60 with a foam channel insert 65 is depicted. The structure of the upper and lower loudspeaker housings 13, 14 shown in FIG. 13A is identical to the structure shown in FIG. 12B, except that the permeable member 60 is a fleece, mesh, or fabric type material that does not require the formation of gas ports 61 in the material. As noted, the acoustic resistance of the fleece, mesh, or fabric type material preferably should not exceed the 260 MKS rayls threshold limit.

Figure 14A:
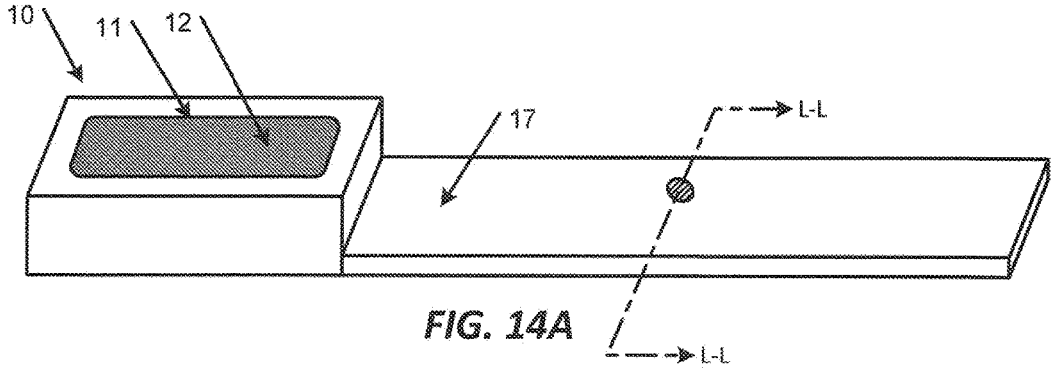
FIG. 14A is a three-quarters view of a loudspeaker device having a slit back volume with a charging port disposed in the vicinity of the back volume.
Figure 14B:
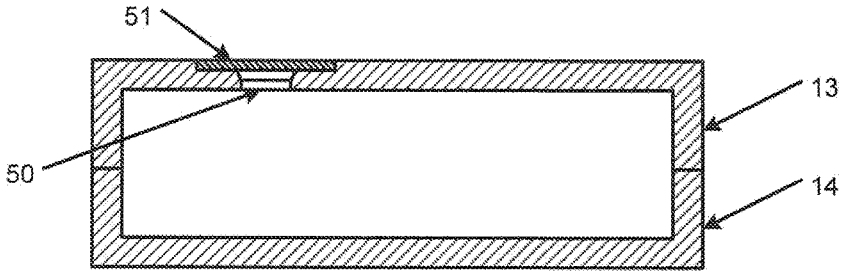
FIG. 14B is an embodiment of the charging port disposed in the vicinity of the back volume.
Figure 14C:
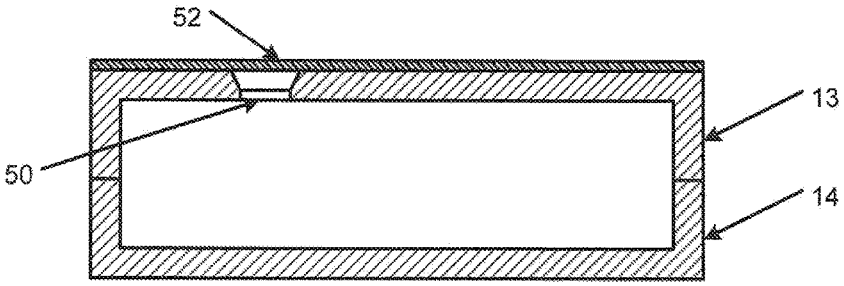
FIG. 14C is another embodiment of the charging port disposed in the vicinity of the back volume.

Referring to FIGS. 14A-14C, an embodiment of a loudspeaker device 10 with a charging port 50 is depicted. The function of the charging port 50 is to enable the sound adsorber material 19 to be dosed into the back volume 17 of the loudspeaker device 10. The amount of sound adsorber material 19 to be dosed into the back volume 17 of the loudspeaker device 10 is measured either volumetrically or gravimetrically, and the amount is determined based on the acoustic response desired. FIG. 14A shows one charging port 50 disposed so it accesses the back volume 17. The location of the charging port 50 will be determined by the location of the foam channel insert inside the back volume 17. For example, if the foam channel insert shown in FIG. 5A was inserted into the back volume 17, then one charging port 50 would be sufficient for dosing the sound adsorber material 19 into the back volume 17. If the foam channel inserts of FIG. 6A or 11C were used, then multiple charging ports 50 would be required to properly dose the sound adsorber material 19 into the various sections of the back volume 17 created by the foam channel insert.

Referring to FIG. 14B, the cross-sectional view along section line L-L of FIG. 14A is shown. The upper and lower loudspeaker housings 13, 14 are shown, and the charging port 50 is shown disposed in the upper loudspeaker housing 13. Preferably, the charging port has a diameter of approximately 1.5 millimeters to accommodate the sound adsorber material 19 being poured into the back volume 17. On the exterior surface of the upper loudspeaker housing 13, the charging port 50 has cavity milled or molded into the exterior surface. The purpose of this charging port cavity is to allow for the charging port seal 51 to be flush-mounted over the charging port 50, and to not protrude above the exterior surface of the upper loudspeaker housing 13. If there are multiple charging ports 50, then preferably each charging port has a cavity that allows flush-mounting of its corresponding charging port seal 51. Alternatively, as shown in FIG. 14C, a gasket 52 can be used to cover a single charging port 50, or multiple charging ports 50. Preferably, the adhesive used for the charging port seal 51 or the gasket 52 does not have any outgassing characteristics that could affect the sound adsorber material 19 in the back volume 17.

Figure 15A:
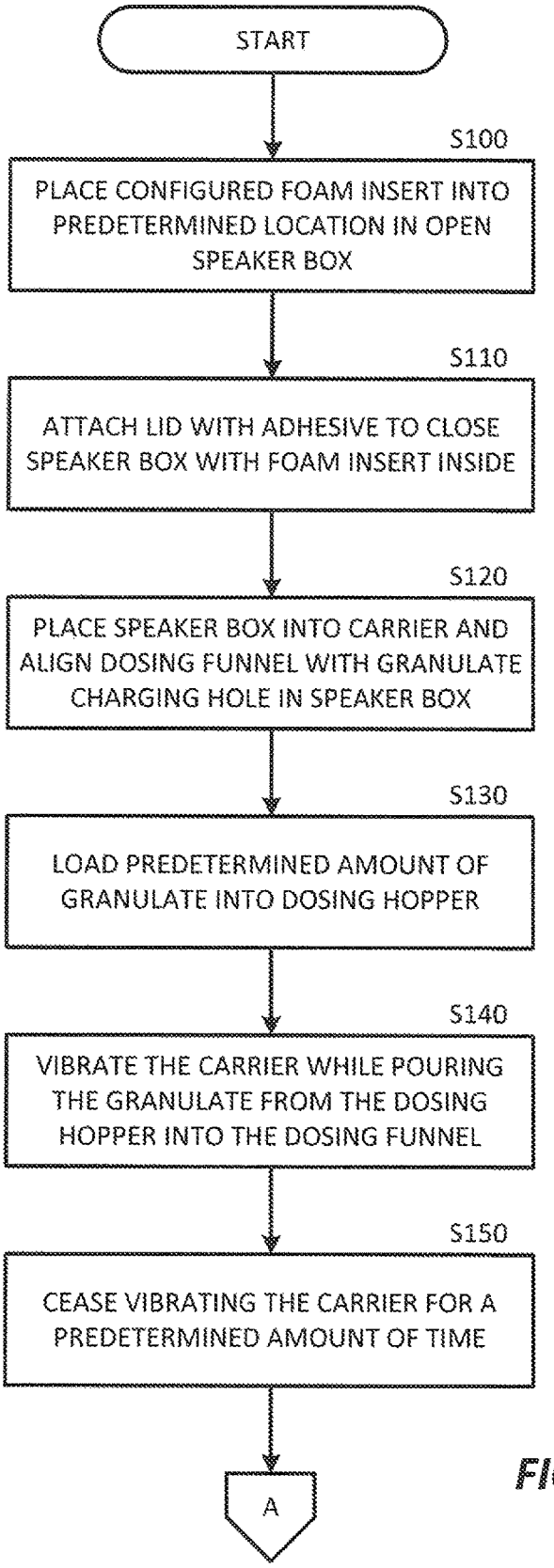
FIGS. 15A-15B is a first embodiment of a method for filling the back volume of the loudspeaker device with sound adsorber material.
Figure 15B:
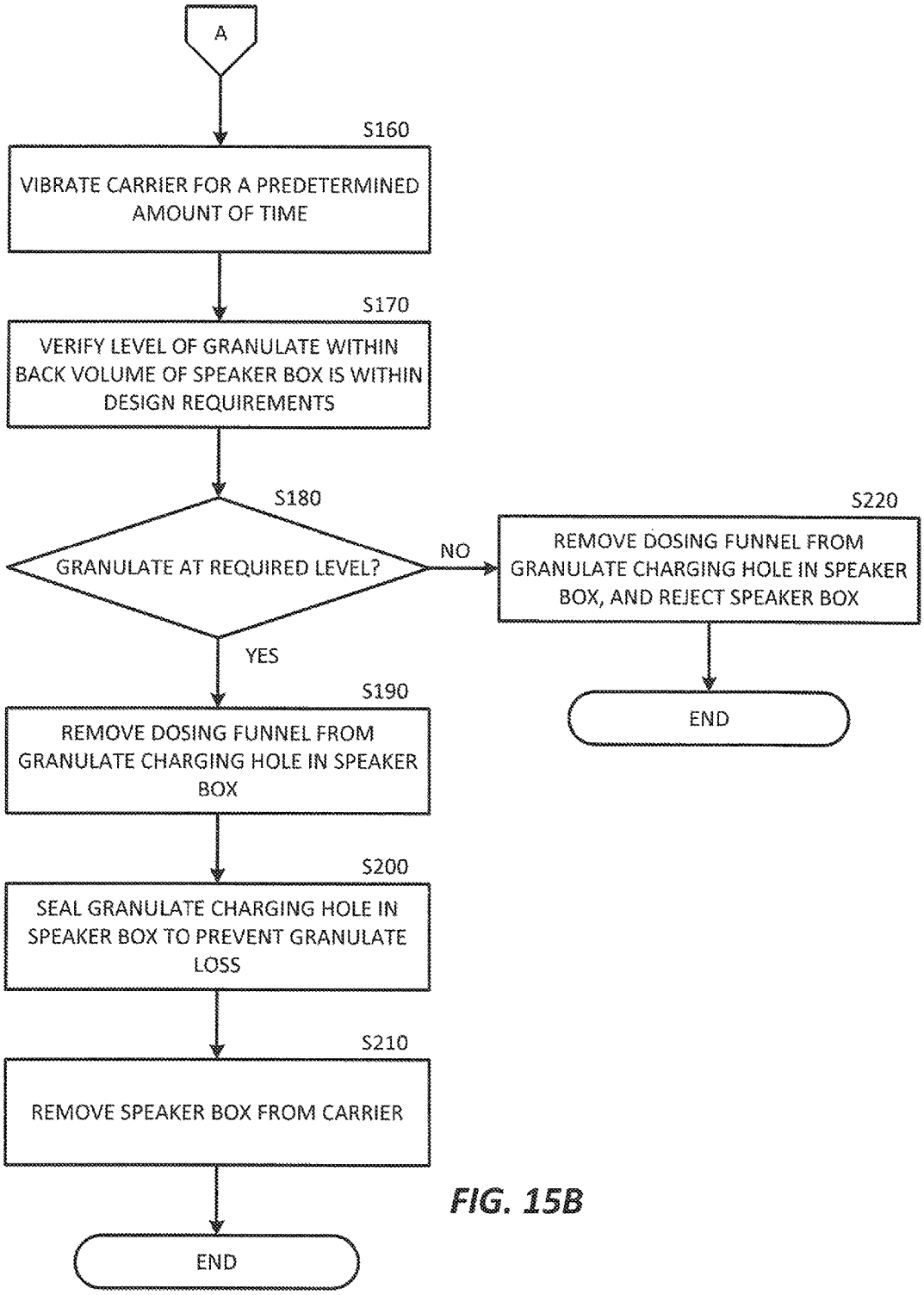

Referring to FIGS. 15A-15B, a method for manufacturing a loudspeaker device that comprises a foam channel insert and sound adsorber material is disclosed. Preferably, the manufacturing method is implemented with computer-controlled manufacturing equipment for the greatest efficiency, although manual assembly of the loudspeaker device is contemplated as well. More specifically, the description of the manufacturing process assumes that the loudspeaker device undergoing assembly has been placed in a carrier device that moves the loudspeaker device through various computer-controlled assembly stations along an assembly track. There might be other steps, such as inserting gaskets or making electrical connections, that are not described in the manufacturing method. These types of steps, however, are generic to the manufacturing process and are not part of the invention.

Referring to FIGS. 15A and 15B, a first embodiment of the manufacturing method for a loudspeaker device comprising a foam channel insert and sound adsorber material will be described. At Step S100, the preconfigured foam channel insert is inserted into position in the back volume of the housing of the loudspeaker device. At this point of the assembly process, the back volume portion of the housing of the loudspeaker device is exposed to facilitate insertion of the foam channel insert. The configuration of the foam channel insert could be one of the embodiments disclosed in FIG. 5A, 6A, 7A, 8A, 9A, 10A, 11A, 11C, or 11D, or an equivalent variation. If the foam channel insert embodiment requires a permeable member, the permeable member will have already been inserted into the housing of the loudspeaker device prior to Step S100.

As Step S110, the lid is attached the rest of the housing of the loudspeaker device, thereby sealing the foam channel insert and, if required, the permeable member into the back volume of the housing of the loudspeaker device. The mechanical attachment of the lid to the rest of the housing is accomplished with fasteners, suitable adhesives, and/or interlocking tabs molded into the housing. If an adhesive is used, preferably the adhesive does not have any outgassing characteristics that could affect the sound adsorber material in the back volume. The attachment of the lid to the remainder of the housing should create a sealed back volume chamber within the housing for the loudspeaker device.

At Step S120, a dosing funnel is aligned with the charging port in the housing of the loudspeaker device. At this stage of the manufacturing process, it is assumed that the loudspeaker device being assembled is situated in a carrier device, and preferably, the carrier device assists in the alignment of dosing funnel with the charging point in the housing. Alternatively, the dosing funnel can be manually aligned with the charging port. The purpose of the dosing funnel is to ensure all the measured dose of sound adsorber material enters the back volume via the charging port. Preferably, a zeolite material having a substantially spherical shape is used as the sound adsorber material, and the form of this zeolite material is preferable for filling the back volume of a closed loudspeaker device.

At Step S130, a predetermined amount of the sound adsorber material is loaded into the dosing hopper. The amount of sound adsorber material that will be loaded into the back volume of the loudspeaker housing is determined based upon the desired acoustic effects that the designer wishes to achieve. For example, the amount of sound adsorber material deposited into the back volume of the loudspeaker housing is dependent upon how much of a resonance shift the acoustic design engineer wishes to achieve. The measurement of the amount of sound adsorber material for insertion into the back volume of the loudspeaker housing is performed either volumetrically or gravimetrically.

At Step S140, the carrier holding the loudspeaker device undergoing dosing is vibrated while the sound adsorber material is being poured from the dosing hopper into the dosing funnel, and thence into the back volume of the loudspeaker device. If the sound adsorber material is in powder, particle, or granulate form, vibrating the loudspeaker housing while the sound adsorber material is being poured into the back volume via the dosing funnel allows the material to spread out relatively quickly and prevent clogs at the charging port during the dosing step.

At Step S150, the vibration of the carrier holding the loudspeaker device is halted for a predetermined amount of time. The halt in vibration allows the sound adsorber material that is now inside the back volume in the housing of the loudspeaker device to settle. The settling of the sound adsorber material is important for measuring whether the back volume has been properly filled.

At Step S160, the vibration of the carrier holding the loudspeaker device is resumed for a predetermined amount of time. The repeated vibration of the loudspeaker device, both during and after the dosing step, is necessary to ensure that the sound adsorber material inside the back volume in the housing has reached all cavities within the back volume. As noted before, the settling of the sound adsorber material is important for measuring whether the back volume has been properly filled. At the conclusion of the second vibration of the loudspeaker device, the dosing funnel is removed from the charging port.

At Step S170, the level of the sound adsorber material inside the back volume of the loudspeaker device is measured. The measurement is performed through the charging port for the sound adsorber material. The measurement can be done visually. More preferably, the level measurement is taken using a laser that illuminates the sound adsorber material visible through the charging port.

At Step S180, the measured level of the sound adsorber material in the back volume is compared against the design requirements for the particular loudspeaker device being manufactured. If the level of sound adsorber material is below design specifications, then, at Step 185, the loudspeaker device rejected. If the level of sound adsorber material is within design specifications, then the manufacturing process moves to Step S190. At Step S190, the dosing funnel is removed from the granulate charging port in the housing of the loudspeaker device under manufacture.

At Step S300, the charging port in the housing of the loudspeaker device under manufacture is sealed to prevent the escape of sound adsorber material from the back volume. The charging port can be sealed in many different ways, e.g., with an insert that fits into the charging port, an adhesive strip placed over the charging port, or a cover over the charging port attached with suitable adhesive. Preferably, the adhesive used for the cover or that is disposed on the adhesive strip does not have any outgassing characteristics that could affect the sound adsorber material in the back volume. After the charging port has been sealed, the loudspeaker device is now complete and ready for audio testing in Step S310.

Figure 16A:
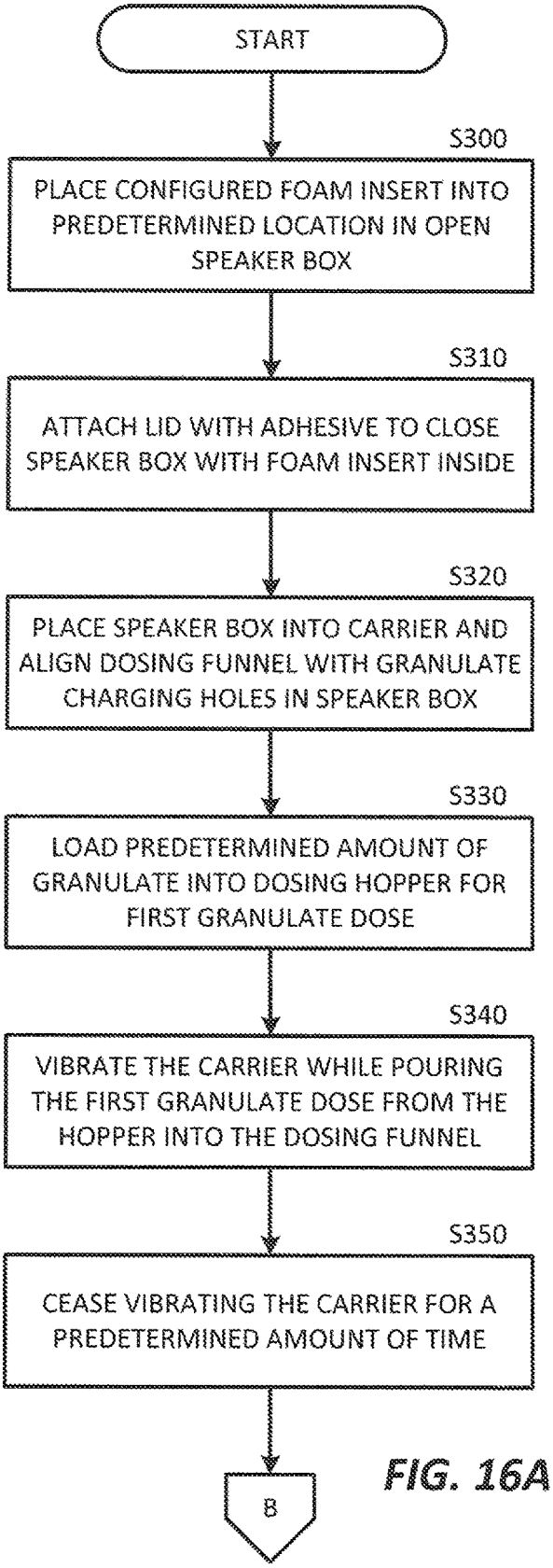
FIGS. 16A-16C is a second embodiment of a method for filling the back volume of the loudspeaker device with sound adsorber material.
Figure 16B:
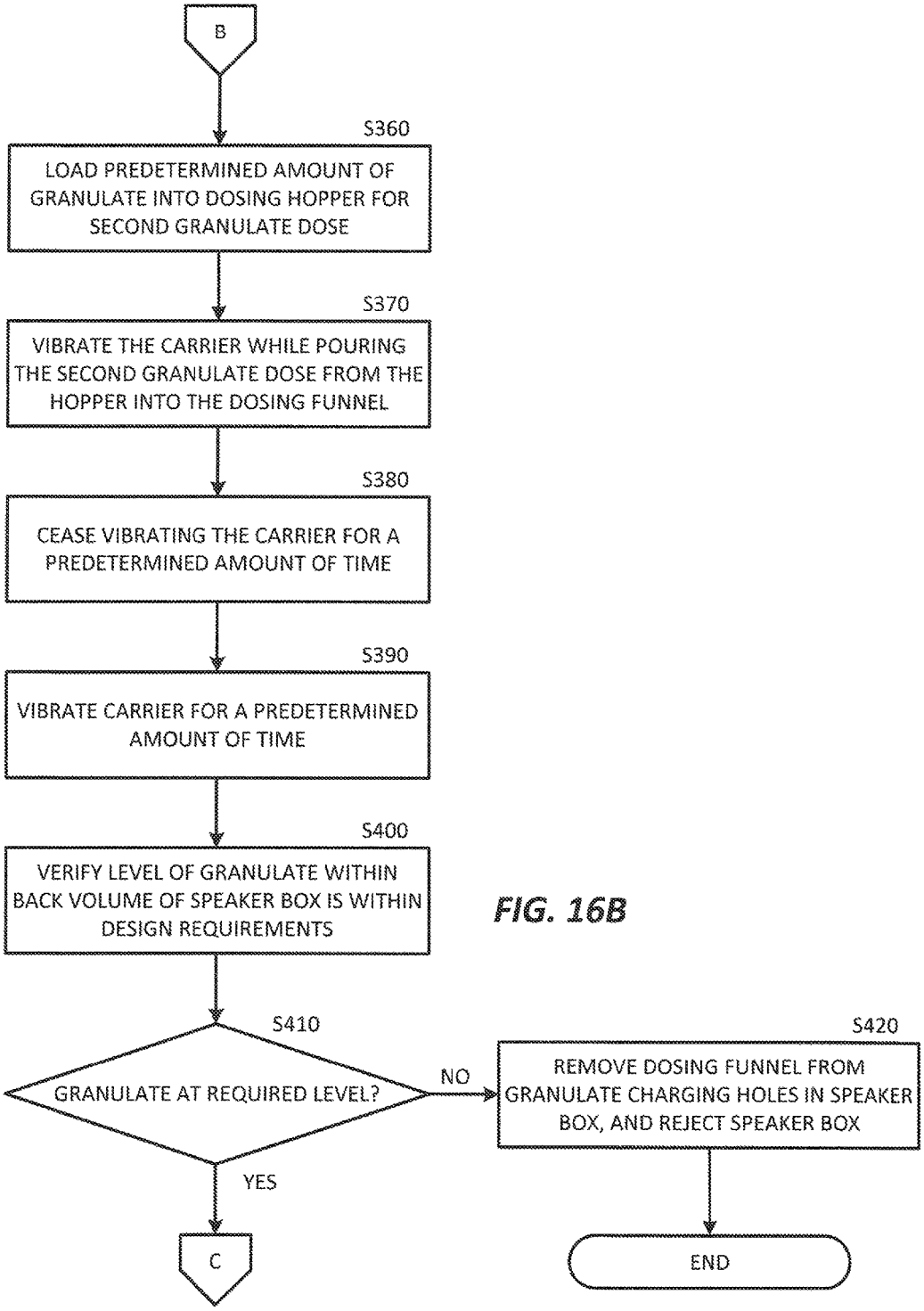
Figure 16C:
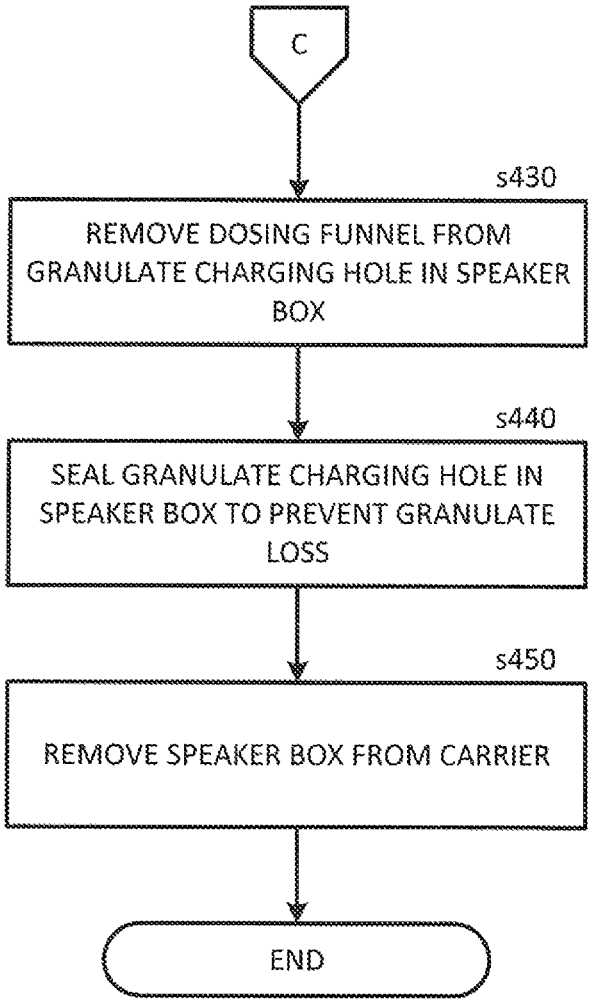

Referring to FIGS. 16A-16C, a second embodiment of the manufacturing method for a loudspeaker device comprising a foam channel insert and sound adsorber material will be described. For this particular embodiment of the manufacturing method, back volumes that are divided in some manner or that are particularly cramped might require multiple charging ports, and thus, multiple dosing steps. At Step S300, the preconfigured foam channel insert is inserted into position in the back volume of the housing of the loudspeaker device. At this point of the assembly process, the back volume portion of the housing of the loudspeaker device is exposed to facilitate insertion of the foam channel insert. The configuration of the foam channel insert could be one of the embodiments disclosed in FIG. 5A, 6A, 7A, 8A, 9A, 10A, 11A, 11C, or 11D, or an equivalent variation. If the foam channel insert embodiment requires a permeable member, the permeable member will have already been inserted into the housing of the loudspeaker device prior to Step S300.

As Step S310, the lid is attached the rest of the housing of the loudspeaker device, thereby sealing the foam channel insert and, if required, the permeable member into the back volume of the housing of the loudspeaker device. The mechanical attachment of the lid to the rest of the housing is accomplished with fasteners, suitable adhesives, and/or interlocking tabs molded into the housing. If an adhesive is used, preferably the adhesive does not have any outgassing characteristics that could affect the sound adsorber material in the back volume. The attachment of the lid to the remainder of the housing should create a sealed back volume chamber within the housing for the loudspeaker device.

At Step S320, a dosing funnel is aligned with one of the multiple charging ports in the housing of the loudspeaker device. At this stage of the manufacturing process, it is assumed that the loudspeaker device being assembled is situated in a carrier device, and preferably, the carrier device assists in the alignment of dosing funnel with the charging point in the housing. Alternatively, the dosing funnel can be manually aligned with one of the charging ports. The purpose of the dosing funnel is to ensure all the measured dose of sound adsorber material enters the back volume via the charging port. Preferably, a zeolite material having a substantially spherical shape is used as the sound adsorber material, and the form of this zeolite material is preferable for filling the back volume of a closed loudspeaker device.

At Step S330, a first dose of a predetermined amount of the sound adsorber material is loaded into the dosing hopper. The amount of sound adsorber material that will be loaded into the back volume of the loudspeaker housing is determined based upon the desired acoustic effects that the designer wishes to achieve. For example, the amount of sound adsorber material deposited into the back volume of the loudspeaker housing is dependent upon how much of a resonance shift the acoustic design engineer wishes to achieve. The measurement of the first dose amount of sound adsorber material for insertion into the back volume of the loudspeaker housing is performed either volumetrically or gravimetrically.

At Step S340, the carrier holding the loudspeaker device undergoing dosing is vibrated while the first dose of sound adsorber material is being poured from the dosing hopper into the dosing funnel, and thence into the back volume of the loudspeaker device. If the sound adsorber material is in powder, particle, or granulate form, vibrating the loudspeaker housing while the sound adsorber material is being poured into the back volume via the dosing funnel allows the material to spread out relatively quickly and prevent clogs at the charging port during the dosing step.

At Step S350, the vibration of the carrier holding the loudspeaker device is halted for a predetermined amount of time. The halt in vibration allows the sound adsorber material that is now inside the back volume in the housing of the loudspeaker device to settle. The settling of the sound adsorber material is important for measuring whether the back volume has been properly filled.

At Step S360, a second dose of a predetermined amount of the sound adsorber material is loaded into the dosing hopper. The amount of sound adsorber material that will be loaded into the back volume of the loudspeaker housing is determined based upon the desired acoustic effects that the designer wishes to achieve. For example, the amount of sound adsorber material deposited into the back volume of the loudspeaker housing is dependent upon how much of a resonance shift the acoustic design engineer wishes to achieve. The measurement of the second dose amount of sound adsorber material for insertion into the back volume of the loudspeaker housing is performed either volumetrically or gravimetrically.

At Step S370, the carrier holding the loudspeaker device undergoing dosing is vibrated while the second dose of sound adsorber material is being poured from the dosing hopper into the dosing funnel, and thence into the back volume of the loudspeaker device. If the sound adsorber material is in powder, particle, or granulate form, vibrating the loudspeaker housing while the sound adsorber material is being poured into the back volume via the dosing funnel allows the material to spread out relatively quickly and prevent clogs at the charging port during the dosing step. A variation on this step uses a single multi-port dosing funnel to accomplish the multiple dosing steps. Alternatively, a specific dosing funnel can be used for each dosing step for a loudspeaker device having multiple charging ports.

At Step S380, the vibration of the carrier holding the loudspeaker device is halted for a predetermined amount of time. The halt in vibration allows the sound adsorber material that is now inside the back volume in the housing of the loudspeaker device to settle. The settling of the sound adsorber material is important for measuring whether the back volume has been properly filled.

At Step S390, the vibration of the carrier holding the loudspeaker device is resumed for a predetermined amount of time. The repeated vibration of the loudspeaker device, both during and after the dosing step, is necessary to ensure that the sound adsorber material inside the back volume in the housing has reached all cavities within the back volume. As noted before, the settling of the sound adsorber material is important for measuring whether the back volume has been properly filled. At the conclusion of the second vibration of the loudspeaker device, the dosing funnel is removed from the charging port.

At Step S400, the level of the sound adsorber material inside the back volume of the loudspeaker device is measured. The measurement is performed through the charging port for the sound adsorber material. The measurement can be done visually. More preferably, the level measurement is taken using a laser that illuminates the sound adsorber material visible through the charging port. For a multiple charging port loudspeaker device, the measurement of the level of sound adsorber material might have to be done at each charging port.

At Step S410, the measured level of the sound adsorber material in the back volume is compared against the design requirements for the particular loudspeaker device being manufactured. If the level of sound adsorber material is below design specifications, then, at Step S420, the loudspeaker device rejected. If the level of sound adsorber material is within design specifications, then the manufacturing process moves to Step S430, in which the dosing funnel (or dosing funnels) are removed from the multiple charging ports.

At Step S440, both charging ports in the housing of the loudspeaker device under manufacture are sealed to prevent the escape of sound adsorber material from the back volume. The charging ports can be sealed in many different ways, e.g., with an insert that fits into each charging port, an adhesive strip placed over each charging port, a cover over each charging port attached with suitable adhesive, or a combination of the foregoing devices to seal the charging ports. Preferably, the adhesive used for the cover or that is disposed on the adhesive strip does not have any outgassing characteristics that could affect the sound adsorber material in the back volume. After the charging port has been sealed, the loudspeaker device is now complete and ready for audio testing at Step S450.

The foregoing description of the preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated.

It should be noted that any entity disclosed herein (e.g., the acoustic element, the container, the loudspeaker device, etc.) are not limited to a dedicated entity as described in some embodiments. Rather, the disclosed invention may be implemented in various ways and with arbitrary granularity on device level while still providing the desired functionality. It should be noted that the term "comprising" does not exclude other elements or steps and the "a" or "an" does not exclude a plurality. In addition, elements described in association with different embodiments may be combined. It should also be noted that reference signs in the claims should not be construed as limiting the scope of the claims. While specific embodiments have been illustrated and described, numerous modifications come to mind without significantly departing from the spirit of the invention, and the scope of protection is only limited by the scope of the accompanying claims. Further, acronyms are used merely to enhance the readability of the specification and claims. It should be noted that these acronyms are not intended to lessen the generality of the terms used and they should not be construed to restrict the scope of the claims to the embodiments described therein.

The invention claimed is:

1. An acoustic transducer device comprising:

an acoustic transducer;

a transducer housing comprising a transducer volume and a back volume, wherein the transducer volume and the back volume are acoustically coupled, and the acoustic transducer is mounted in the transducer volume;

a charging port disposed in the portion of the transducer housing where the back volume is located;

a preconfigured foam insert disposed in the back volume;

a permeable member disposed between the transducer volume and the back volume, wherein the preconfigured foam insert and the permeable member configure a cavity within the back volume; and an amount of sound adsorber material disposed within the cavity defined by the permeable member and preconfigured foam insert, wherein the preconfigured foam insert and the permeable member facilitate gas exchange between the transducer volume and the back volume.

2. An acoustic transducer device according to claim 1, wherein the preconfigured foam insert is disposed along an interior surface of the back volume.

3. An acoustic transducer device according to claim 1, wherein the preconfigured foam insert is disposed such that the back volume is divided into two cavities.

4. An acoustic transducer device according to claim 3, wherein the transducer housing further comprises a charging port for each of the cavities.

5. An acoustic transducer device according to claim 1, wherein the preconfigured foam insert comprises two foam inserts, each disposed along an interior surface of the back volume.

6. An acoustic transducer device according to claim 1, wherein the preconfigured foam insert has a triangular shape.

7. An acoustic transducer device according to claim 1, wherein the preconfigured foam insert has a complex polygon shape.

8. An acoustic transducer device according to claim 1, wherein the preconfigured foam insert has a shape having at least one curved surface.

9. An acoustic transducer device according to claim 1, wherein the permeable member is one of a group consisting of a polypropylene film comprising gas vents, a fleece material, a mesh material, or a filter material.

10. An acoustic transducer device according to claim 1, wherein the sound adsorber material comprises a substantially spherically shaped zeolite-based material having a mean diameter of at least 300 microns.

11. A loudspeaker device comprising:

a loudspeaker housing comprising a loudspeaker volume and a preconfigured back volume, wherein the loudspeaker volume and the back volume are acoustically coupled;

a loudspeaker mounted in the loudspeaker volume;

a charging port disposed in the portion of the loudspeaker housing where the preconfigured back volume is located;

a preconfigured foam insert disposed in the preconfigured back volume, wherein the preconfigured foam insert is shaped to match the internal surfaces of the preconfigured back volume;

a permeable member disposed between the loudspeaker volume and the preconfigured back volume, wherein the preconfigured foam insert and the permeable member configure a cavity within the preconfigured back volume; and an amount of sound adsorber material disposed within the cavity defined by the permeable member and the preconfigured foam insert, wherein the preconfigured foam insert and the permeable member facilitate gas exchange between the loudspeaker volume and the preconfigured back volume.

12. An acoustic transducer device according to claim 1, wherein the preconfigured foam insert has a triangular shape.

13. An acoustic transducer device according to claim 1, wherein the preconfigured foam insert has a complex polygon shape.

14. An acoustic transducer device according to claim 1, wherein the preconfigured foam insert has a shape having at least one curved surface.

15. An acoustic transducer device according to claim 1, wherein the permeable member is one of a group consisting of a polypropylene film comprising gas vents, a fleece material, a mesh material, or a filter material.

16. An acoustic transducer device according to claim 1, wherein the sound adsorber material comprises a substantially spherically shaped zeolite-based material having a mean diameter of at least 300 microns.

* * * * *